US011326815B2

(12) United States Patent
Minami et al.

(10) Patent No.: US 11,326,815 B2
(45) Date of Patent: May 10, 2022

(54) HEAT EXCHANGER AND REFRIGERATION CYCLE APPARATUS

(71) Applicant: Mitsubishi Electric Corporation, Chiyoda-ku (JP)

(72) Inventors: Shinichiro Minami, Chiyoda-ku (JP); Yoji Onaka, Chiyoda-ku (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 66 days.

(21) Appl. No.: 16/613,042

(22) PCT Filed: Jun. 30, 2017

(86) PCT No.: PCT/JP2017/024193

§ 371 (c)(1),
(2) Date: Nov. 12, 2019

(87) PCT Pub. No.: WO2019/003428

PCT Pub. Date: Jan. 3, 2019

(65) Prior Publication Data

US 2020/0200449 A1 Jun. 25, 2020

(51) Int. Cl.
*F25B 39/02* (2006.01)
*F25B 39/00* (2006.01)
(Continued)

(52) U.S. Cl.
CPC ..... *F25B 39/00* (2013.01); *F25B 41/00* (2013.01); *F28F 9/0202* (2013.01); *F25B 13/00* (2013.01);
(Continued)

(58) Field of Classification Search
CPC ..... F25B 39/00; F25B 41/00; F25B 13/00; F28F 9/02; F28F 9/0202; F28D 1/05391;
(Continued)

(56) References Cited

U.S. PATENT DOCUMENTS 10,670,344 B2 * 6/2020 Ito ..... F28F 1/022
2015/0083377 A1 * 3/2015 Jindou ..... F28D 1/05375 165/143
(Continued)

FOREIGN PATENT DOCUMENTS

CN 105358918 A 2/2016
JP 5-215474 A 8/1993
(Continued)

OTHER PUBLICATIONS

International Search Report dated Sep. 12, 2017 in PCT/JP2017/024193 filed on Jun. 30, 2017.
(Continued)

*Primary Examiner* — Henry T Crenshaw
*Assistant Examiner* — Kamran Tavakoldavani
(74) *Attorney, Agent, or Firm* — Xsensus LLP

(57) ABSTRACT

A heat exchanger includes heat exchanger cores connected to a distributor. The inside of the distributor is divided into refrigerant flow paths, allowing the refrigerant to flow from one of the refrigerant flow paths to another one of the refrigerant flow paths. The heat transfer tubes of one of the heat exchanger cores disposed on a windward side of a flow of the air fed to the heat exchanger are connected to at least one of the refrigerant flow paths disposed in the distributor on an upstream side of a flow of the refrigerant. The heat transfer tubes of one of the heat exchanger cores disposed on a leeward side of the flow of the air fed to the heat exchanger are connected to at least one of the refrigerant flow paths disposed in the distributor on a downstream side of the flow of the refrigerant.

21 Claims, 23 Drawing Sheets

(51) Int. Cl.

| | |
|---|---|
| ***F25B 41/00*** | (2021.01) |
| ***F28F 9/02*** | (2006.01) |
| *F25B 13/00* | (2006.01) |
| *F28D 1/053* | (2006.01) |
| *F28D 21/00* | (2006.01) |

(52) U.S. Cl.
CPC .. *F28D 1/05391* (2013.01); *F28D 2021/0071* (2013.01); *F28D 2021/0084* (2013.01)

(58) Field of Classification Search
CPC .. F28D 1/053; F28D 1/05308; F28D 1/05316; F28D 1/05325; F28D 1/05333; F28D 1/05341; F28D 1/0452; F28D 1/0426; F28D 2021/0071; F28D 2021/0084
USPC ..... 62/515
See application file for complete search history.

(56) References Cited

U.S. PATENT DOCUMENTS

| | | | | |
|---|---|---|---|---|
| 2016/0054077 | A1* | 2/2016 | Saito | F25B 39/00 165/173 |
| 2016/0370042 | A1 | 12/2016 | Onaka et al. | |
| 2017/0211868 | A1* | 7/2017 | Junge | F25B 5/00 |
| 2017/0292741 | A1* | 10/2017 | Inoue | F25B 13/00 |

FOREIGN PATENT DOCUMENTS

| | | | |
|---|---|---|---|
| JP | 2012-251696 | A | 12/2012 |
| JP | 2013-2773 | A | 1/2013 |
| WO | WO2016/121124 | A1 | 8/2016 |

OTHER PUBLICATIONS

Office Action dated Jan. 8, 2021 issued in corresponding CN patent application No. 201780091541.1 (and Machine Translation).

* cited by examiner

HEAT EXCHANGER AND REFRIGERATION CYCLE APPARATUS

CROSS-REFERENCE TO RELATED APPLICATIONS

This application is a United States national stage application of International Application No. PCT/JP2017/024193, filed Jun. 30, 2017, which designates the United States and the entire contents of each of the above applications are hereby incorporated herein by reference in entirety.

TECHNICAL FIELD

The present invention relates to a heat exchanger and a refrigeration cycle apparatus that include a header that distributes refrigerant.

BACKGROUND ART

A heat exchanger of an existing air-conditioning apparatus includes a heat exchanger core that includes multiple heat transfer tubes and multiple fins, and a header to which the heat transfer tubes are connected. Under the conditions where refrigerant circulates in a refrigerant cycle of an air-conditioning apparatus at a low flow rate, a liquid refrigerant may fail to flow to an upper portion of the header. In addition, with the effect of gravity, a liquid refrigerant flows to a lower portion of the header at a high flow rate. Thus, the performance in distributing the liquid refrigerant to the heat transfer tubes to the heat exchanger core may be degraded, and the heat exchanger may degrade its performance. To equally distribute a liquid refrigerant to the multiple heat transfer tubes, a header that distributes refrigerant and has a double pipe structure has been developed. For example, in a heat exchanger described in Patent Literature 1, a refrigerant feed pipe is inserted into a header pipe, into which refrigerant flows, from a lower end to an upper end of the header pipe. In addition, a heat exchanger core described in Patent Literature 2 includes a pair of headers in each of which a partitioning wall is disposed to form an outer passage and an inner passage. Disposed between the pair of headers are a tube that connects the outer passage of a first header to the inner passage of a second header, a tube that connects the inner passage of the first header to the inner passage of the second header, and a tube that connects the inner passage of the first header to the outer passage of the second header. The number of these tubes is adjusted to gradually reduce the area over which refrigerant passes from the entrance to the exit of the heat exchanger core to thus make the temperature distribution uniform.

CITATION LIST

Patent Literature

Patent Literature 1: Japanese Unexamined Patent Application Publication No. 2013-2773

Patent Literature 2: Japanese Unexamined Patent Application Publication No. 5-215474

SUMMARY OF INVENTION

Technical Problem

When the header pipe according to Patent Literature 1 is used in a heat exchanger including multiple heat exchanger cores, the heat exchanger will have only limited improvement in its heat exchange efficiency, provided that the number of paths through which the refrigerant flows from the header pipe to the multiple heat exchanger cores remains the same. This is because, regardless of the fact that the difference in temperature between the refrigerant and air in the heat exchanger core on a windward side of the fed air flow is larger than the difference in temperature between the refrigerant and air in the heat exchanger core on a leeward side of the air flow, the refrigerant in the heat exchanger core on the windward side has a temperature about the same as the temperature of the refrigerant in the heat exchanger core on the leeward side. The header and the tube of Patent Literature 2 have a structure that reduces the area over which refrigerant passes. Thus, when they are employed in a heat exchanger including multiple heat exchanger cores, the heat exchanger core disposed on the windward side of the fed air fails to produce a sufficient heat exchange efficiency.

The present invention has been made to solve the above problem, and aims to improve the heat exchange efficiency of a heat exchanger including multiple heat exchanger cores.

Solution to Problem

A heat exchanger according to one embodiment of the present invention is a heat exchanger that allows air and refrigerant to exchange heat therebetween. The heat exchanger includes multiple heat exchanger cores including multiple heat transfer tubes arranged side by side and multiple fins; and a distributor to which the multiple heat transfer tubes of the multiple heat exchanger cores are connected to distribute the refrigerant therebetween, the distributor having an inside divided into multiple refrigerant flow paths, the distributor allowing the refrigerant flowing into one of the multiple refrigerant flow paths to flow from the one of the plurality of refrigerant flow paths to an other one of the multiple refrigerant flow paths. The multiple heat transfer tubes of one of the multiple heat exchanger cores disposed on a windward side of a flow of the fed air are connected to at least one of the refrigerant flow paths disposed in the distributor on an upstream side of a flow of the refrigerant. The multiple heat transfer tubes of one of the multiple heat exchanger cores disposed on a leeward side of a flow of the fed air are connected to at least one of the refrigerant flow paths disposed in the distributor on a downstream side of a flow of the refrigerant.

A refrigeration cycle apparatus according to one embodiment of the present invention is a refrigeration cycle apparatus that includes a heat exchanger and a gas-liquid separator disposed upstream of the heat exchanger. The apparatus includes a first refrigerant circuit that connects a lower portion of the gas-liquid separator and an upstream side of the heat exchanger, and a second refrigerant circuit that connects an upper portion of the gas-liquid separator and a downstream side of the heat exchanger. The second refrigerant circuit includes a flow control valve that adjusts a flow rate of the refrigerant.

Advantageous Effects of Invention

In a heat exchanger according to one embodiment of the present invention, a liquid refrigerant is allowed to flow at a higher rate to the heat transfer tubes of the heat exchanger core disposed on the windward side of the air flow. By allowing a liquid refrigerant to flow at a higher rate to the heat exchanger core disposed on the windward side in which the temperature difference between the liquid refrigerant and air is relatively large, the heat exchanger can improve its heat exchange efficiency.

In a refrigeration cycle apparatus according to one embodiment of the present invention, a second refrigerant circuit that bypasses the heat exchanger including the multiple heat exchanger cores includes a flow control valve that is connected to an upper portion of a gas-liquid separator and that adjusts the flow rate of the refrigerant. Thus, by opening or closing the flow control valve in accordance with an operation load of the refrigeration cycle apparatus, the heat exchanger can improve the heat exchange efficiency or prevent reduction of the heat exchange efficiency.

DESCRIPTION OF EMBODIMENTS

A heat exchanger of each of embodiments of the present invention will be now described in detail with reference to the drawings. The present invention is not limited to the embodiments described below. Throughout the drawings described below, the dimensions of each component may differ from those in an actual apparatus.

Embodiment 1

Figure 1:
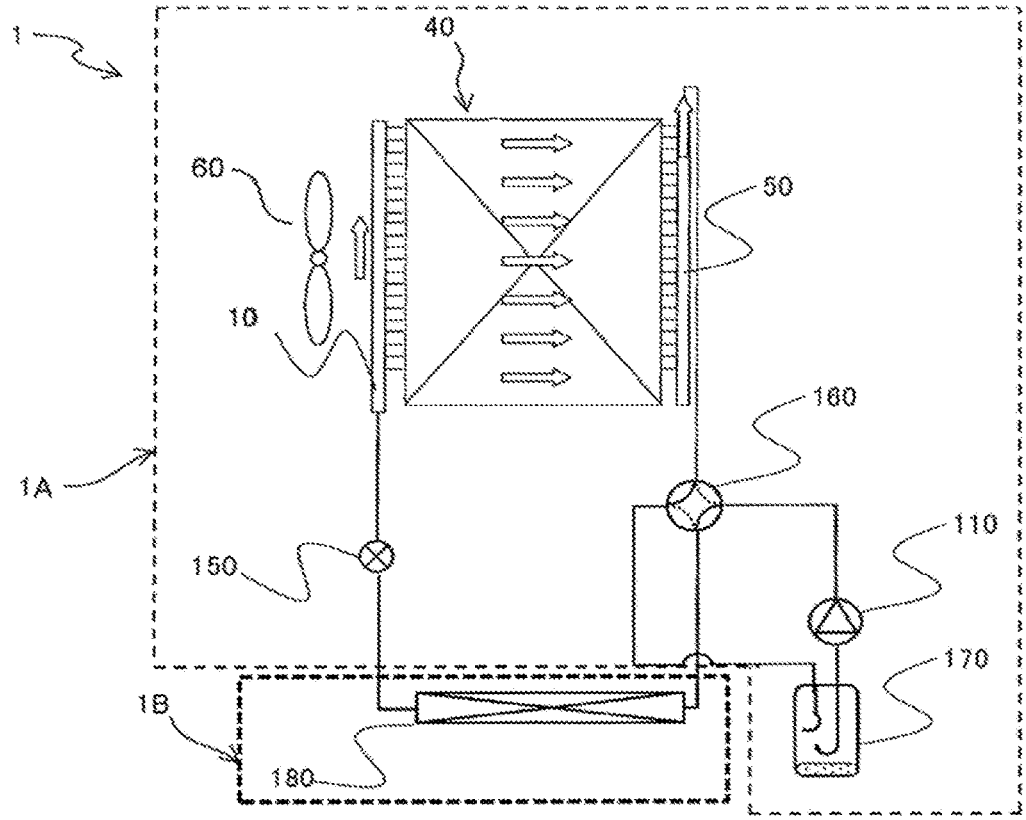
FIG. 1 is a schematic diagram of a refrigerant cycle configuration of a refrigeration cycle apparatus according to Embodiment 1 of the present invention.
Figure 2:
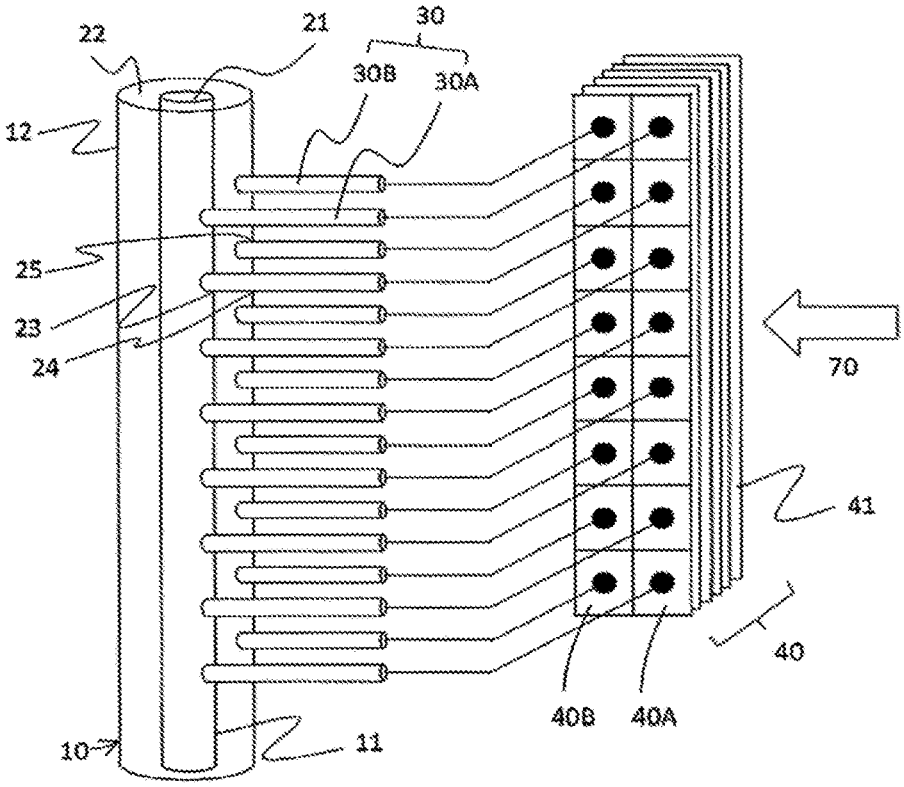
FIG. 2 is a schematic diagram of a structure of a header refrigerant distributor according to Embodiment 1.

FIG. 1 is a schematic diagram of a refrigerant cycle configuration of a refrigeration cycle apparatus according to Embodiment 1 of the present invention. FIG. 2 is a schematic diagram of a structure of a header refrigerant distributor according to Embodiment 1. A refrigeration cycle apparatus 1 according to Embodiment 1 is an air-conditioning apparatus that performs air-conditioning of a room, which is subjected to air conditioning, and includes a heat source side unit 1A and a use side unit 1B. The heat source side unit 1A forms, together with the use side unit 1B, a refrigeration cycle that circulates refrigerant to remove or supply heat for air conditioning. The heat source side unit 1A is disposed outdoor. The heat source side unit 1A includes a compressor 110, a flow path switching device 160, a heat source side heat exchanger 40, a throttle device 150, an accumulator 170, and a fan 60. The use side unit 1B is disposed in a room that is subjected to air conditioning, and includes a use side heat exchanger 180 and a fan, not illustrated. The refrigeration cycle apparatus 1 has a refrigeration cycle that includes the compressor 110, the flow path switching device 160, the use side heat exchanger 180, the heat source side heat exchanger 40, and the throttle device 150.

The compressor 110 compresses sucked refrigerant into a high-temperature high-pressure refrigerant. The compressor 110 is formed from a scroll compressor or a reciprocating compressor. The heat source side heat exchanger 40 includes a header refrigerant distributor 10, a header refrigerant collector 50, multiple fins 41 (refer to FIG. 2), and multiple heat transfer tubes 30 (refer to FIG. 2) arranged vertically. The fan of the heat source side unit 1A is used to supply air to the heat source side heat exchanger 40. The flow path switching device 160 switches between a heating flow path and a cooling flow path in accordance with switching of an operation mode between a cooling operation and a heating operation. The flow path switching device 160 is formed from a four-way valve. During the heating operation, the flow path switching device 160 connects the discharge side of the compressor 110 to the use side heat exchanger 180, and connects the heat source side heat exchanger 40 to the accumulator 170. During the cooling operation, the flow path switching device 160 connects the discharge side of the compressor 110 to the heat source side heat exchanger 40, and connects the use side heat exchanger 180 to the accumulator 170. FIG. 1 illustrates a case where a four-way valve is used as the flow path switching device 160 by way of example. Instead, multiple two-way valves may be combined to form the flow path switching device 160.

As illustrated in FIG. 2, the header refrigerant distributor 10 includes a cylindrical inner pipe 11 and a cylindrical outer pipe 12. The inner pipe 11 is disposed in the outer pipe 12 while the inner pipe 11 and the outer pipe 12 are aligned to be coaxial, that is, the header refrigerant distributor 10 has a double pipe structure. The header refrigerant distributor 10 includes an inner pipe flow path 21 and an annular flow path 22 to serve as refrigerant flow paths through which refrigerant flows. The inner pipe flow path 21 is defined by the inner side of the inner pipe 11. The annular flow path 22 is defined by the outer side of the inner pipe 11 and the inner side of the outer pipe 12, and has an annular cross section.

The heat source side heat exchanger 40 includes a heat exchanger core 40A and a heat exchanger core 40B. In FIG. 2, a hollow arrow 70 denotes the direction of air flow fed by the above-described fan and passing through the heat source side heat exchanger 40. The heat exchanger core 40A is disposed on the windward side of the air flow, and the heat exchanger core 40B is disposed on the leeward side of the air flow. The heat exchanger core 40A includes multiple plate-shaped fins 41 and multiple heat transfer tubes 30A. The multiple fins 41 are spaced apart from each other in their plate thickness direction. Each of the multiple heat transfer tubes 30A extends through the multiple fins 41 in the plate thickness direction of the multiple fins 41. The fins 41 and the heat transfer tubes 30A are joined together. The heat exchanger core 40B includes the multiple fins 41 and multiple heat transfer tubes 30B. The multiple fins 41 are spaced apart from each other in their plate thickness direction. Each of the multiple heat transfer tubes 30B extends through the multiple fins 41 in the plate thickness direction of the multiple fins 41. The fins 41 and the heat transfer tubes 30B are joined together. In the present description, the heat transfer tubes 30A and the heat transfer tubes 30B may be collectively referred to as heat transfer tubes 30.

The outer pipe 12 has multiple insertion holes 24 and multiple insertion holes 25. The heat transfer tubes 30A are respectively inserted into the multiple insertion holes 24. The heat transfer tubes 30B are respectively inserted into the multiple insertion holes 25. The inner pipe 11 has multiple insertion holes 23. The heat transfer tubes 30A extending through the insertion holes 24 of the outer pipe 12 are respectively inserted into the multiple insertion holes 23. In the above structure, the multiple heat transfer tubes 30A are connected to the inner pipe 11, and the multiple heat transfer tubes 30B are connected to the outer pipe 12. Thus, the heat transfer tubes 30A and the inner pipe flow path 21 are connected together, and the heat transfer tubes 30B and the outer pipe 12 are connected together.

Flow of air that passes through the heat source side heat exchanger 40 is determined by the rotational direction of the fan and the positional relationship between the fan and the heat source side heat exchanger 40. For example, if the fan is a unit that rotates in such a direction as to suck air from the heat source side heat exchanger 40, a core disposed further from the fan is defined as a heat exchanger core on the windward side, and a core disposed closer to the fan is defined as a heat exchanger core on the leeward side.

Figure 3:
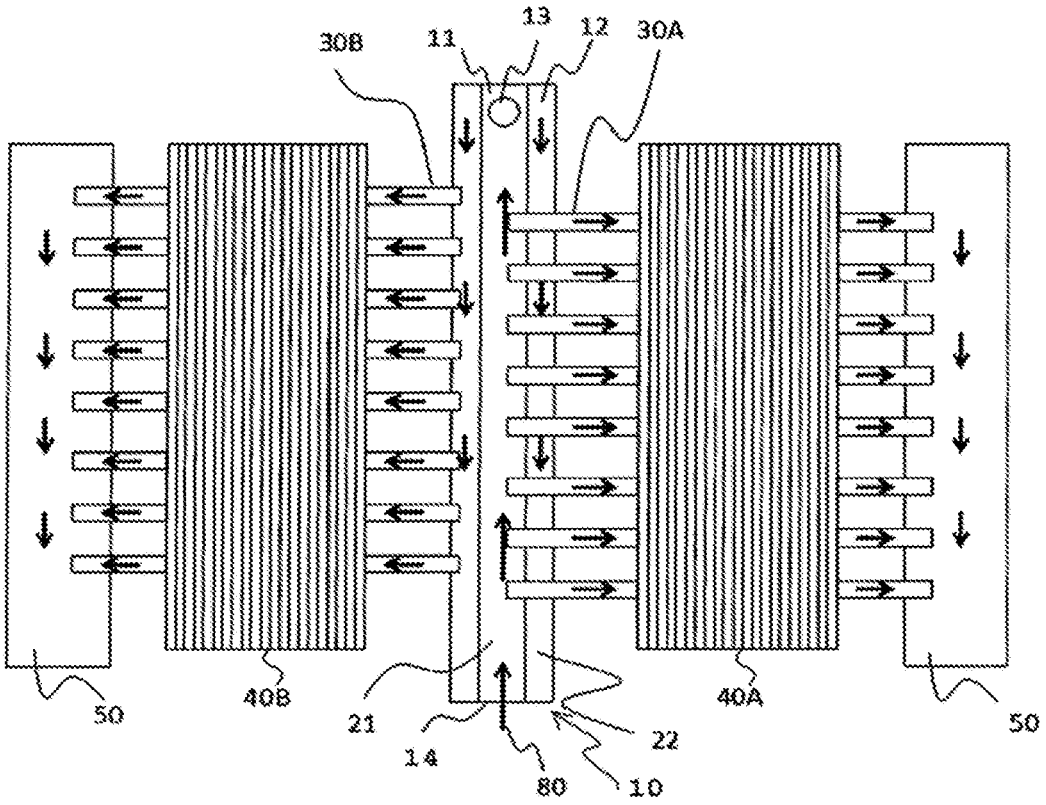
FIG. 3 is a schematic diagram of a structure of a heat source side heat exchanger according to Embodiment 1.

FIG. 3 is a schematic diagram of a structure of a heat source side heat exchanger according to Embodiment 1. At a lower end portion of the header refrigerant distributor 10 among both end portions of the inner pipe 11, an inlet port 14 into which refrigerant flows is disposed. At an upper end portion of the header refrigerant distributor 10 among both end portions of the inner pipe 11, a discharge port 13 is formed. The discharge port 13 connects the inner pipe flow path 21 to the annular flow path 22. When the refrigeration cycle apparatus 1 performs a heating operation and the heat source side heat exchanger 40 operates as an evaporator, a two-phase gas-liquid refrigerant flows into the header refrigerant distributor 10. As illustrated FIG. 3 with arrow 80, refrigerant flows in from the inlet port 14 of the inner pipe 11 of the header refrigerant distributor 10 and flows through the inner pipe flow path 21. As described above, the heat transfer tubes 30A and the inner pipe flow path 21 are connected together, and thus part of the refrigerant flows through the heat transfer tubes 30A. Through the heat transfer tubes 30A, refrigerant is fed to the heat exchanger core 40A on the windward side. The refrigerant left without flowing to the heat transfer tubes 30A passes through the discharge port 13 and flows to the annular flow path 22. As described above, the heat transfer tubes 30B and the annular flow path 22 are connected together, and thus the refrigerant flows through the heat transfer tubes 30B. Through the heat transfer tubes 30B, the refrigerant is fed to the heat exchanger core 40B on the leeward side.

Figure 4:
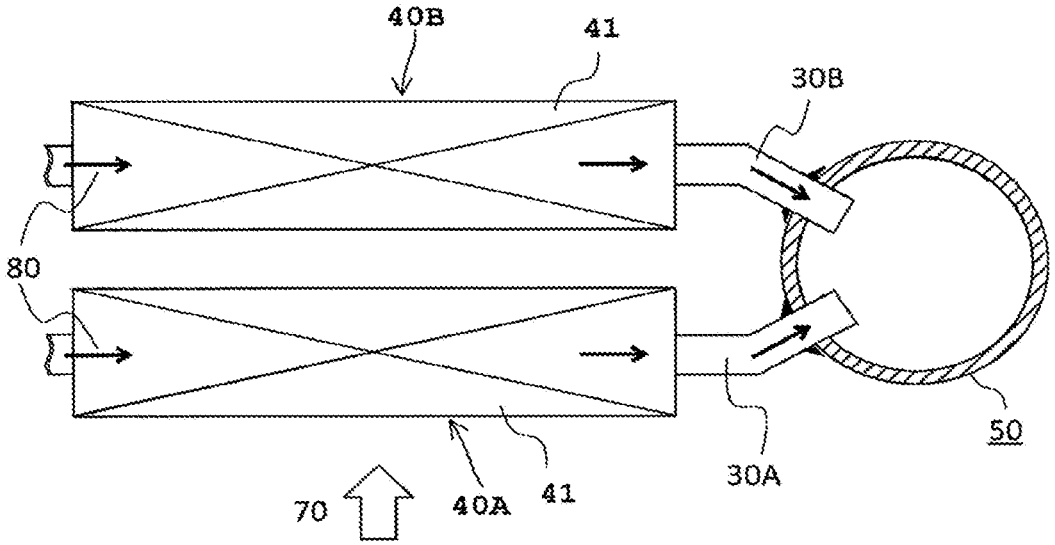
FIG. 4 is a schematic diagram of a structure of a header refrigerant collector according to Embodiment 1.

FIG. 4 is a schematic diagram of a structure of a header refrigerant collector according to Embodiment 1. As illustrated in FIG. 4, the heat transfer tubes 30A that extend through the fins 41 of the heat exchanger core 40A and the heat transfer tubes 30B that extend through the fins 41 of the heat exchanger core 40B are connected to the header refrigerant collector 50 disposed opposite to the header refrigerant distributor 10. Specifically, in Embodiment 1, the heat exchanger core 40A on the windward side and the heat exchanger core 40B on the leeward side are connected in parallel. The structure where the heat exchanger core 40A on the windward side and the heat exchanger core 40B core on the leeward side are connected in series increases the in-pipe pressure loss, and degrades the efficiency of refrigerant distribution in a pass direction in which the refrigerant flows from upstream to downstream. Embodiment 1 where the heat exchanger core 40A and the heat exchanger core 40B are connected in parallel to distribute the refrigerant can improve the refrigerant distribution efficiency compared to the case where the heat exchanger core 40A and the heat exchanger core 40B are connected in series. Thus, the heat source side heat exchanger 40 can improve its heat exchange efficiency.

Generally, a liquid refrigerant flows at a relatively high rate to the upstream side of a refrigerant flow path. In Embodiment 1, the refrigerant that has flowed into the header refrigerant distributor 10 flows into the inner pipe 11, through the inner pipe flow path 21 and the heat transfer tubes 30A, and to the heat exchanger core 40A. Thereafter, the refrigerant left without flowing to the inner pipe flow path 21 flows out to the outer pipe 12 through the discharge port 13, and flows through the annular flow path 22 and the heat transfer tubes 30B to the heat exchanger core 40B.

Specifically, in Embodiment 1, in the flow of refrigerant, the heat transfer tubes 30A are disposed on the upstream side of the heat transfer tubes 30B, and thus can distribute a liquid refrigerant to the heat transfer tubes 30A in preference to the heat transfer tubes 30B. This structure allows a liquid refrigerant to flow at a higher rate to the heat exchanger core 40A on the windward side, that is, the heat exchanger core 40A in the first row in which the difference in temperature between air and refrigerant is large. Thus, the heat source side heat exchanger 40 can improve its heat exchange efficiency.

Figure 5:
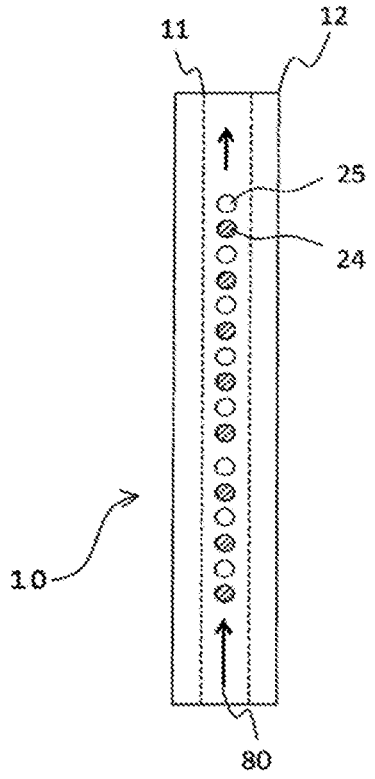
FIG. 5 is a schematic side view of a header refrigerant distributor according to Embodiment 1, viewed from the side having insertion holes.
Figure 6:
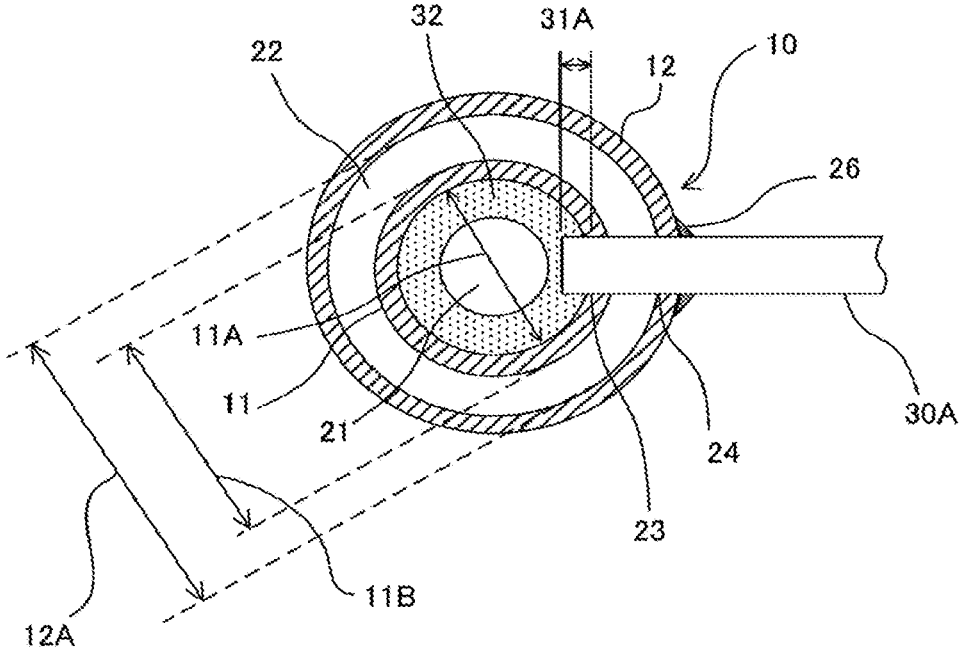
FIG. 6 is a cross-sectional view of a heat transfer tube according to Embodiment 1 inserted into a header refrigerant distributor.
Figure 7:
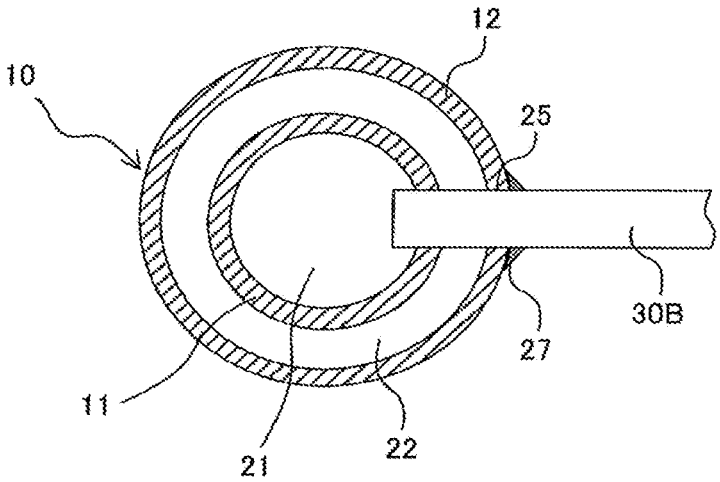
FIG. 7 is a cross-sectional view of the heat transfer tube according to Embodiment 1 inserted into the header refrigerant distributor.

Here, the arrangement between the heat transfer tubes 30A and the heat transfer tubes 30B will be described. FIG. 5 is a schematic side view of a header refrigerant distributor according to Embodiment 1, viewed from the side having insertion holes. FIG. 6 and FIG. 7 are cross-sectional views of a heat transfer tube according to Embodiment 1 inserted into a header refrigerant distributor. In FIG. 5, for ease of understanding, the position of the inner pipe 11 inside the header refrigerant distributor 10 is expressed in dotted lines. In FIG. 5, to clearly illustrate the arrangement of the insertion holes 24 and the insertion holes 25, only the insertion holes 24 are hatched. FIG. 6 is a cross-sectional view of the header refrigerant distributor 10 and one heat transfer tube 30A taken along a plane perpendicular to the center axis of the header refrigerant distributor 10 at the position of the axis of the heat transfer tube 30A. FIG. 7 is a cross-sectional view of the header refrigerant distributor 10 and one heat transfer tube 30B taken along a plane perpendicular to the center axis of the header refrigerant distributor 10 at the position of the axis of the heat transfer tube 30B.

A two-phase gas-liquid refrigerant that has flowed into the header refrigerant distributor 10 of the heat source side heat exchanger 40 has its liquid adhering to the wall surface of the inner pipe 11 having high resistance whereas its gas distributed to an area near the center axis of the inner pipe 11 due to the difference in density between gas and liquid. Thus, as illustrated in FIG. 6, a liquid membrane 32 is formed on the inner wall surface of the inner pipe 11. In Embodiment 1, an amount of insertion of each of the heat transfer tubes 30A is defined as follows. The amount of insertion of each of the heat transfer tubes 30A is a distance from the position of the inner wall of the inner pipe 11 that receives the heat transfer tubes 30A to the tip position of the inserted heat transfer tube 30A. As illustrated in FIG. 6, the amount of insertion 31A of the heat transfer tubes 30A is determined to be smaller than or equal to the thickness of the liquid membrane 32 formed on the inner wall of the inner pipe 11, so that a liquid refrigerant flowing through the heat transfer tubes 30A is finely distributed, and the heat exchange efficiency is also improved.

Figure 8:
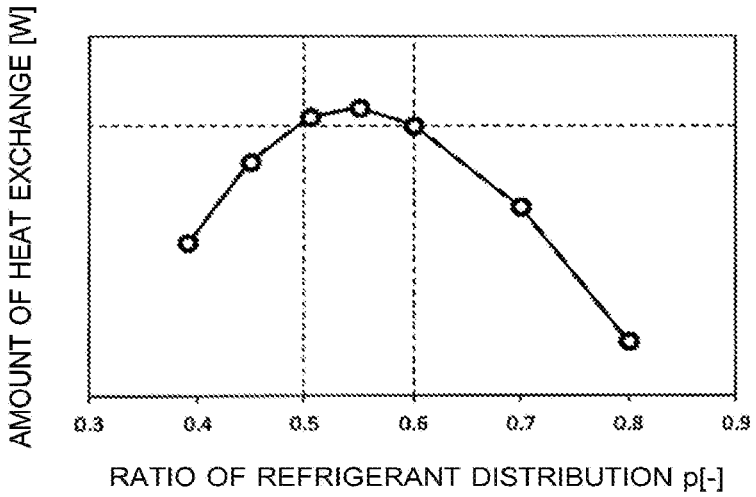
FIG. 8 is a graph for comparison of the heat exchange efficiency based on a refrigerant distribution ratio.

FIG. 8 is a graph for comparison of the heat exchange efficiency based on a refrigerant distribution ratio. In the graph in FIG. 8, a horizontal axis expresses a refrigerant distribution ratio and a vertical axis expresses the amount of heat exchanged. The graph in FIG. 8 shows an example of a change of the exchanged amount of heat of the heat source side heat exchanger 40 when the heat source side heat exchanger 40 according to Embodiment 1 performs a heating operation to change the ratio of the amount of circulating refrigerant at the entrance of the heat exchanger core 40A and the amount of circulating refrigerant at the entrance of the heat exchanger core 40B. When the ratio of the amount of circulating refrigerant flowing through the heat exchanger core 40A on the windward side or in the first row to the entire amount of circulating refrigerant in the refrigeration cycle of the refrigeration cycle apparatus 1 is denoted with p, p=the amount of circulating refrigerant in the first row of the heat exchanger/the entire amount of circulating refrigerant. As illustrated in FIG. 8, the exchanged amount of heat is high when p is within the range of 0.5 to 0.6. Thus, an inside diameter 12A of the outer pipe 12, an inside diameter 11A and an outside diameter 11B of the inner pipe 11, and the amount of insertion 31A of the heat transfer tube need to be determined to satisfy that p falls within the range of 0.5 to 0.6, and circulating refrigerant needs to be distributed to the heat exchanger core 40A in the first row and the heat exchanger core 40B in the second row at such a rate that p falls within the range of 0.5 to 0.6.

As illustrated in FIG. 5, the insertion holes 24 for the heat transfer tubes 30A connected to the heat exchanger core 40A on the windward side and the insertion holes 25 for the heat transfer tubes 30B connected to the heat exchanger core 40B on the leeward side are alternately formed on a straight line in the longitudinal direction of the header refrigerant distributor 10. As illustrated in FIG. 6 and FIG. 7, the heat transfer tubes 30A and the heat transfer tubes 30B are located in a direction crossing the center axis of the header refrigerant distributor 10. Thus, a liquid refrigerant easily flows from the header refrigerant distributor 10 to the heat transfer tubes 30A and the heat transfer tubes 30B.

In Embodiment 1, the heat transfer tubes 30A, the heat transfer tubes 30B, and the header refrigerant distributor 10 are joined together by soldering. Only the contact portions between the outer pipe 12 and the heat transfer tubes 30A and 30B may be soldered. As illustrated in FIG. 6, each of the heat transfer tubes 30A and the outer pipe 12 are soldered to form a solder portion 26. As illustrated in FIG. 7, each of the heat transfer tubes 30B and the outer pipe 12 are soldered to form a solder portion 27. Soldering at the connection portions between the inner pipe 11 and the heat transfer tubes 30A is not essential. A gap formed between the insertion hole 23 and each of the heat transfer tubes 30A is allowable. On the other hand, each of the insertion holes 24 and the corresponding one of the heat transfer tubes 30A and each of the insertion holes 25 and the corresponding one of the heat transfer tubes 30B need to be joined by soldering. Thus, a gap between them is preferably as small as possible while a gap required for assembly is secured. In Embodiment 1, soldering at the connection portion between the inner pipe 11 and each of the heat transfer tubes 30A can be omitted to reduce soldered portions. Thus, the header refrigerant distributor can be manufactured at a low cost.

As described above, the header refrigerant distributor 10 according to Embodiment 1 has a double pipe structure including the inner pipe 11 and the outer pipe 12. Thus, compared to the case where multiple header refrigerant distributors are provided, the heat transfer tubes 30 can be efficiently arranged, so that the header refrigerant distributor 10 can be made small. Thus, a heat exchanger having a double pipe structure can be installed in a relatively small space. The inner pipe 11 and the outer pipe 12 can be made of general-purpose hollow cylinder members. Specifically, Embodiment 1 can provide a small-sized high-performance heat exchanger at low costs.

The heat source side heat exchanger 40 according to Embodiment 1 allows refrigerant to flow through the heat exchanger core 40A in the first row and the heat exchanger core 40B in the second row in parallel. Thus, compared to the case where refrigerant flows in series through the heat exchanger core 40A in the first row and the heat exchanger core 40B in the second row, the pressure loss in the flow path of the heat exchanger can be reduced. Generally, the outdoor unit during a heating operation significantly degrades the heat exchange efficiency of the heat exchanger when the fin surfaces of the heat exchanger are frosted while the evaporating pressure is reduced due to the pressure loss. The heat source side heat exchanger 40 according to Embodiment 1 is also suitable for preventing such a defect that can be caused when the outdoor unit during a heating operation is frosted.

Figure 9:
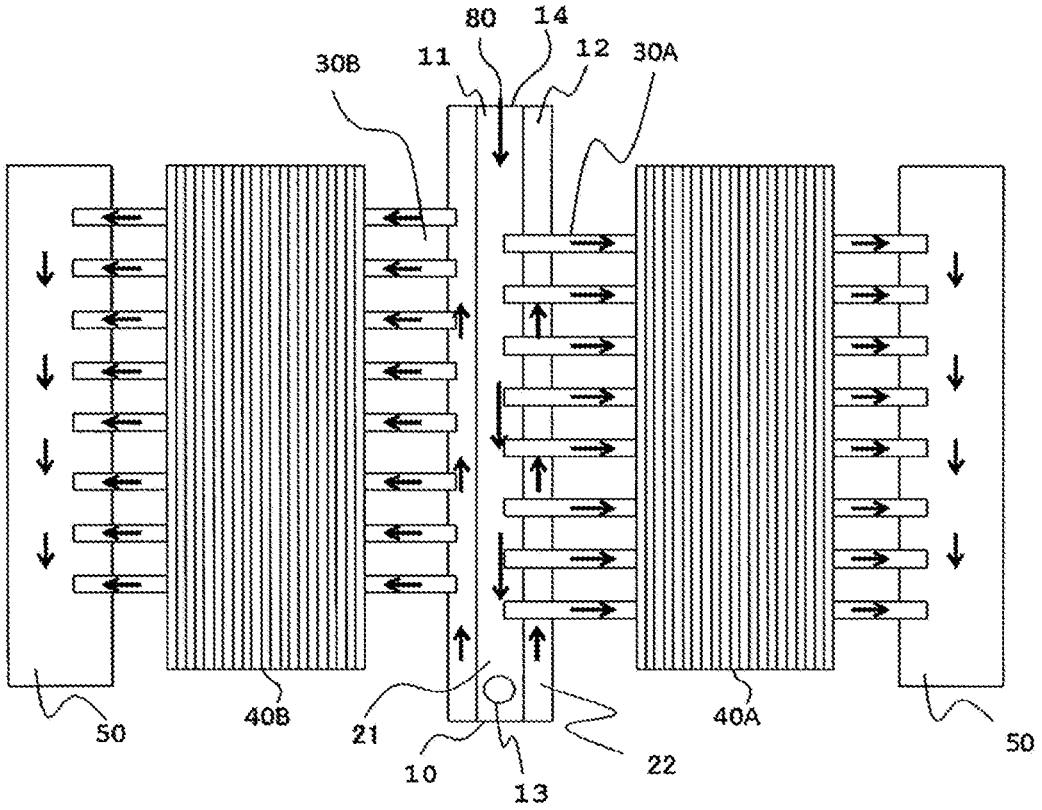
FIG. 9 is a schematic diagram of a structure of a heat source side heat exchanger according to a modification example of Embodiment 1.

FIG. 9 is a schematic diagram of a structure of a heat source side heat exchanger according to a modification example of Embodiment 1. In this modification example, the inlet port 14 into which refrigerant flows is formed at one of both end portions of the inner pipe 11 disposed at an upper portion of the header refrigerant distributor 10. The discharge port 13 that connects the inner pipe flow path 21 and the annular flow path 22 together is formed at one of both ends portions of the inner pipe 11 disposed at a lower portion of the header refrigerant distributor 10. As illustrated in FIG. 8, the double pipe structure of the header refrigerant distributor 10 effectively improves the heat exchange efficiency of the heat source side heat exchanger 40 also when the refrigerant in the inner pipe flow path 21 flows downward. Specifically, compared to an existing header refrigerant distributor used for a downward flow, the heat exchanger improves its heat exchange efficiency when the double pipe structure is used for a downward flow as in a modification example of Embodiment 1. The header refrigerant distributor having a double pipe structure is effective to a header refrigerant distributor having an existing structure regardless of whether the refrigerant flows either upward or downward in the inner pipe flow path 21.

Embodiment 2

Figure 10:
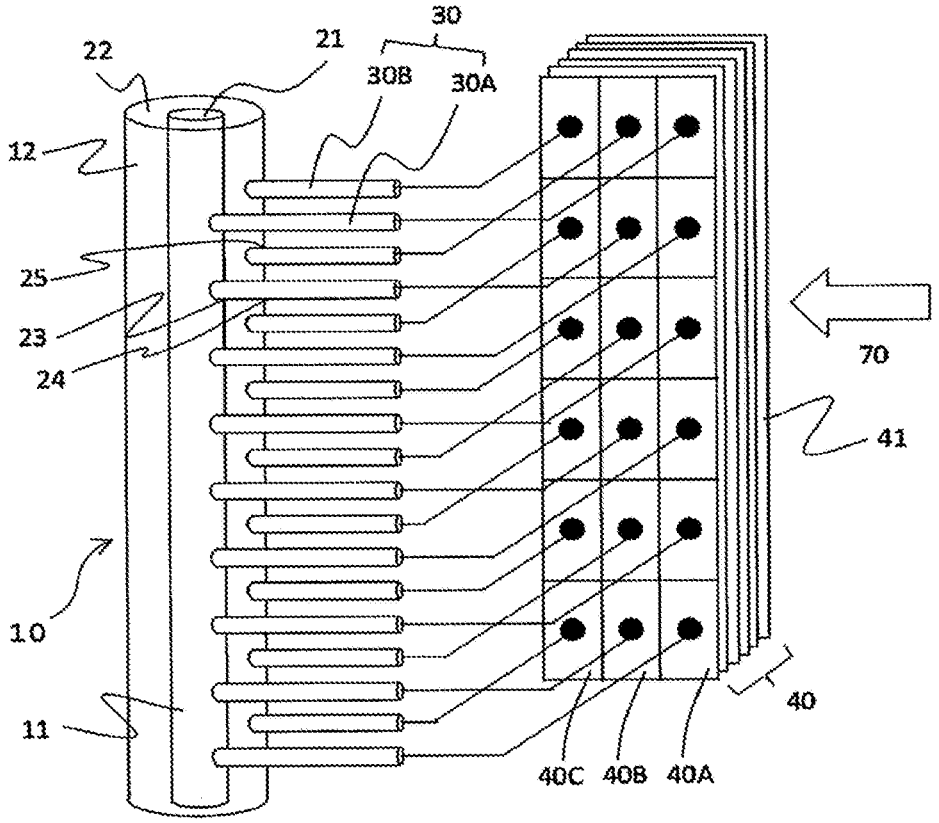
FIG. 10 is a schematic diagram of a structure of a header refrigerant distributor according to Embodiment 2 of the present invention.

With reference to FIG. 10 to FIG. 13, Embodiment 2 of the present invention will be described. In FIG. 10 to FIG. 13, components the same as or equivalent to those in Embodiment 1 are denoted with the same reference signs, and components the same as those in Embodiment 1 will not be fully described. FIG. 10 is a schematic diagram of a structure of a header refrigerant distributor according to Embodiment 2 of the present invention. Embodiment 2 differs from Embodiment 1 in that the heat source side heat exchanger 40 is formed from heat exchanger cores in three rows. In Embodiment 2, the heat source side heat exchanger 40 includes a heat exchanger core 40A in a first row, a heat exchanger core 40B in a second row, and a heat exchanger core 40C in a third row, arranged from the windward side. The heat transfer tubes 30A are connected to the inner pipe 11, and the heat transfer tubes 30B are connected to the outer pipe 12. The heat transfer tubes 30A are connected to the heat exchanger core 40A in the first row, the heat transfer tubes 30A and the heat transfer tubes 30B are connected to the heat exchanger core 40B in the second row, and the heat transfer tubes 30B are connected to the heat exchanger core 40C in the third row.

Figure 11:
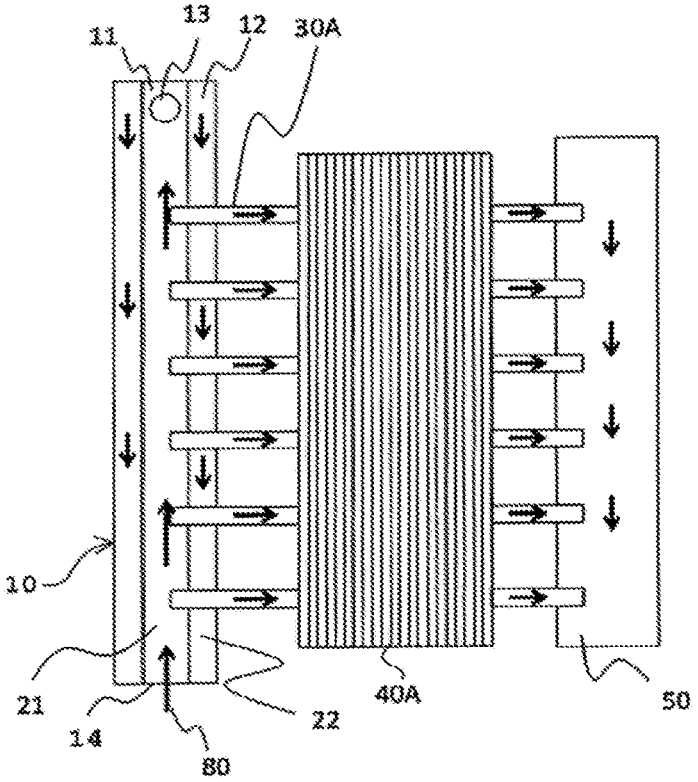
FIG. 11 is a schematic diagram of a structure of a heat exchanger core in a first row, a header refrigerant distributor, and a header refrigerant collector of the heat exchanger according to Embodiment 2.
Figure 12:
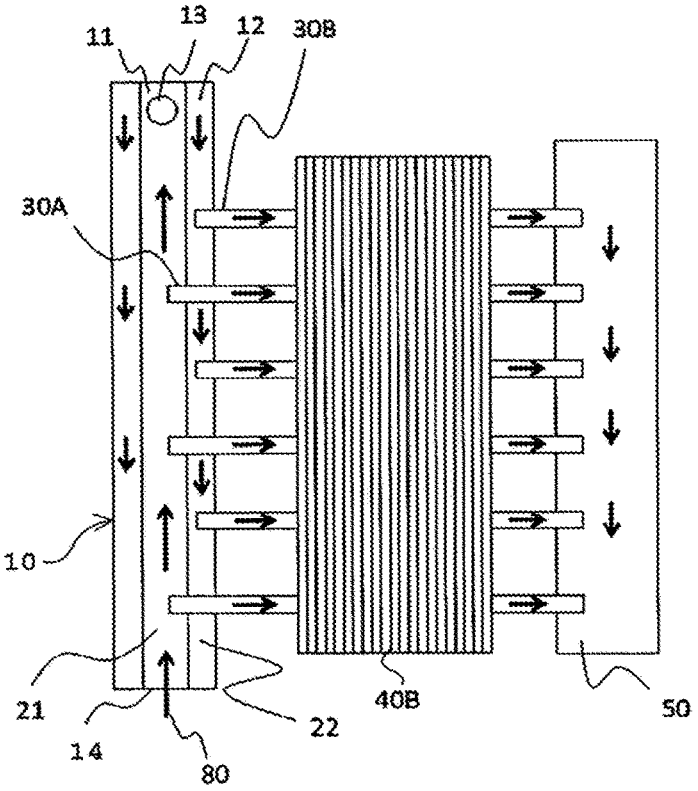
FIG. 12 is a schematic diagram of a structure of a heat exchanger core in a second row, a header refrigerant distributor, and a header refrigerant collector of the heat exchanger according to Embodiment 2.
Figure 13:
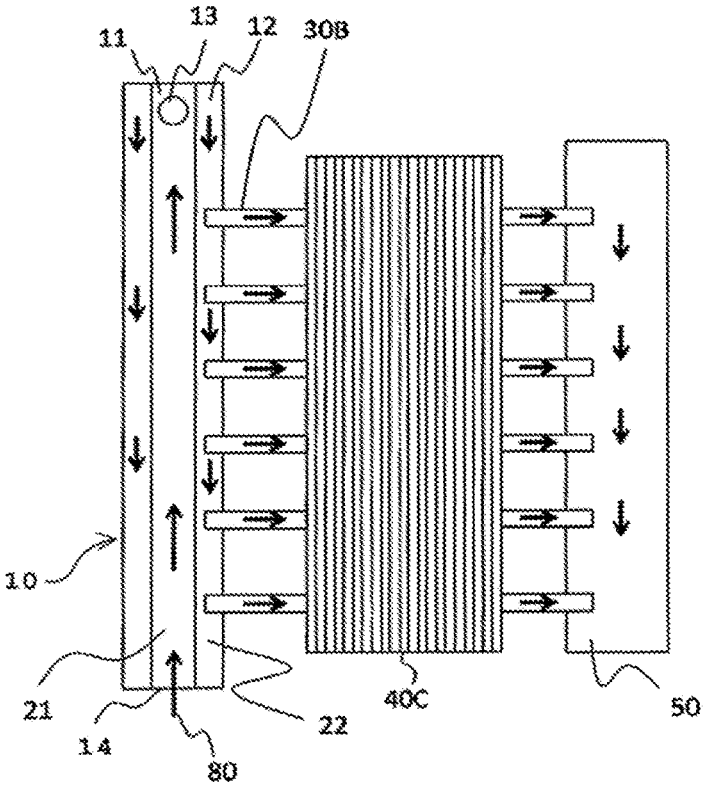
FIG. 13 is a schematic diagram of a structure of a heat exchanger core in a third row, a header refrigerant distributor, and a header refrigerant collector of the heat exchanger according to Embodiment 2.

FIG. 11 is a schematic diagram of a structure of a heat exchanger core in a first row, a header refrigerant distributor, and a header refrigerant collector of the heat exchanger according to Embodiment 2. FIG. 12 is a schematic diagram of a structure of a heat exchanger core in a second row, a header refrigerant distributor, and a header refrigerant collector of the heat exchanger according to Embodiment 2. FIG. 13 is a schematic diagram of a structure of a heat exchanger core in a third row, a header refrigerant distributor, and a header refrigerant collector of the heat exchanger according to Embodiment 2. As illustrated in FIG. 11 and FIG. 12, the number of heat transfer tubes 30A connected to the heat exchanger core 40B is half the number of the heat transfer tubes 30A connected to the heat exchanger core 40A. As illustrated in FIG. 12 and FIG. 13, the number of heat transfer tubes 30B connected to the heat exchanger core 40B is half the number of heat transfer tubes 30B connected to a heat exchanger core 40C. In other words, the heat transfer tubes 30A connected to the heat exchanger core 40B in the second row correspond to 50% of the heat transfer tubes 30A connected to the heat exchanger core 40B in the first row, and the heat transfer tubes 30B connected to the heat exchanger core 40B in the second row correspond to 50% of the heat transfer tubes 30B connected to the heat exchanger core 40C in the third row.

In the above structure, of a liquid refrigerant can be distributed at a higher rate to the heat exchanger core 40B in the second row than to the heat exchanger core 40C in the third row, and a liquid refrigerant can be distributed at a higher rate to the heat exchanger core 40A in the first row than to the heat exchanger core 40B in the second row. Specifically, liquid refrigerant can be distributed at a higher rate to a heat exchanger core disposed closer to the windward side. Thus, a heat exchanger including heat exchanger cores arranged in three rows can improve the heat exchange efficiency.

The ratio of the number of heat transfer tubes 30A connected to the heat exchanger core 40B to the number of heat transfer tubes 30A connected to the heat exchanger core 40A is not limited to 50%. In addition, the ratio of the number of heat transfer tubes 30B connected to the heat exchanger core 40B to the number of heat transfer tubes 30B connected to the heat exchanger core 40C is not limited to 50%.

A heat exchanger including heat exchanger cores arranged in four or more rows also has a structure similar to that in the above modification example. Specifically, a heat exchanger core including heat transfer tubes and disposed on the upstream side in a refrigerant cycle is disposed on the windward of or in the same row as the heat exchanger core including heat transfer tubes and disposed on the downstream in the refrigerant cycle. In this structure, a heat exchanger including heat exchanger cores arranged in four or more rows can also achieve the above effects.

Embodiment 3

Figure 14:
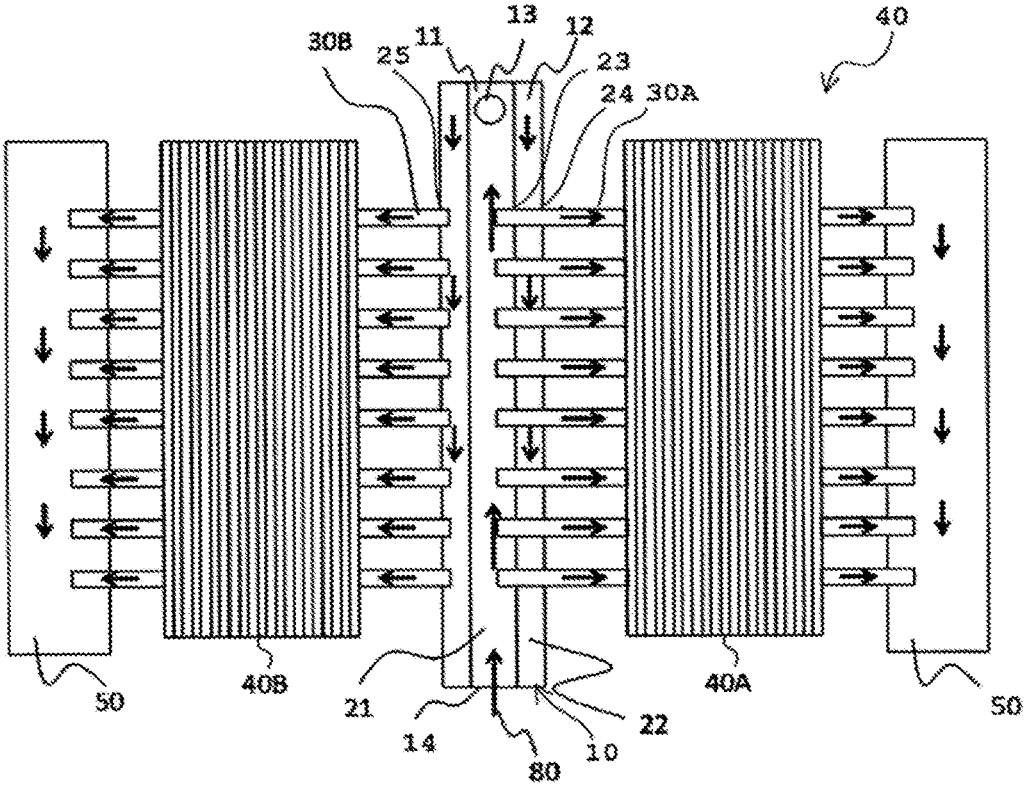
FIG. 14 is a schematic diagram of a structure of a heat source side heat exchanger according to Embodiment 3 of the present invention.

Embodiment 3 of the present invention will now be described with reference to FIG. 14 to FIG. 18. In FIG. 14 to FIG. 18, components the same as or equivalent to those in Embodiment 1 and Embodiment 2 are denoted with the same reference signs, and components the same as those in Embodiment 1 and Embodiment 2 will not fully be described. FIG. 14 is a schematic diagram of a structure of a heat source side heat exchanger according to Embodiment 3 of the present invention. The header refrigerant distributor 10 includes an inner pipe 11 and an outer pipe 12 and has a double pipe structure. The inner pipe flow path 21 is defined by the inner side of the inner pipe 11. The annular flow path 22 is defined by the outer side of the inner pipe 11 and the inner side of the outer pipe 12, and has an annular cross section. The inner pipe 11 has insertion holes 23 into which the heat transfer tubes 30A are inserted. The outer pipe 12 has insertion holes 24 into which the heat transfer tubes 30A are inserted, and insertion holes 25 into which the heat transfer tubes 30B are inserted. The heat transfer tubes 30A extending through the outer pipe 12 through the insertion holes 24 are inserted into the inner pipe 11 through the multiple insertion holes 23. The heat transfer tubes 30B are inserted into the outer pipe 12 through the insertion holes 25.

When the heat source side heat exchanger 40 operates as an evaporator, a two-phase gas-liquid refrigerant flows into the header refrigerant distributor 10 through the inlet port 14 in a direction denoted with arrow 80 in FIG. 14. As illustrated in FIG. 14, refrigerant that flows into the header refrigerant distributor 10 flows along the inner pipe flow path 21 first, and then flows along the annular flow path 22 through the discharge port 13 formed in the inner pipe 11.

Since the inner pipe flow path 21 and the heat transfer tubes 30A are connected together, a liquid refrigerant is fed from the inner pipe flow path 21 to the heat exchanger core 40A on the windward side. Since the annular flow path 22 and the heat transfer tubes 30B are connected together, a liquid refrigerant is fed from the annular flow path 22 to the heat exchanger core 40B on the leeward side. Naturally, a liquid refrigerant flows through the inner pipe flow path 21 at a higher rate than a liquid refrigerant flowing through the annular flow path 22. Thus, a liquid refrigerant can be preferentially distributed to the heat transfer tubes 30A. The structure that allows a liquid refrigerant to flow at a higher rate to the heat exchanger core 40A in the first row having a larger temperature difference between air and refrigerant can improve its heat exchange efficiency.

Figure 15:
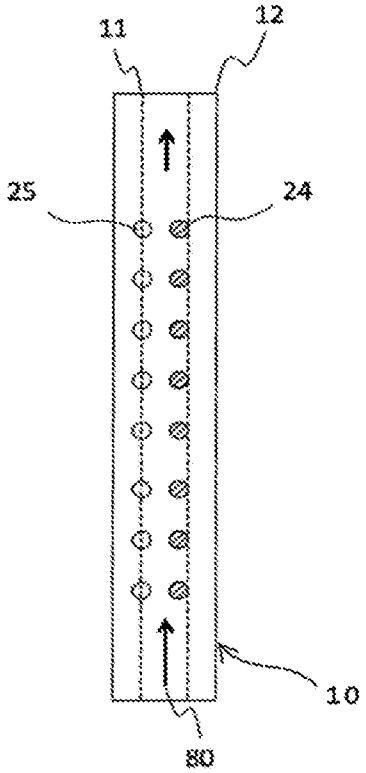
FIG. 15 is a schematic diagram of a positional relationship between an inner pipe, an outer pipe, and insertion holes of a header refrigerant distributor according to Embodiment 3.

FIG. 15 is a schematic diagram of a positional relationship between an inner pipe, an outer pipe, and insertion holes of a header refrigerant distributor according to Embodiment 3. In FIG. 15, for ease of understanding, the position of the inner pipe 11 inside the header refrigerant distributor 10 is expressed with dotted lines. In FIG. 15, to clearly illustrate the arrangement of the insertion holes 24 and the insertion holes 25, only the insertion holes 24 into which the heat transfer tubes 30A are inserted are hatched. In the outer pipe 12 of the header refrigerant distributor 10 according to Embodiment 3, the insertion holes 24 for the heat transfer tubes 30A and the insertion holes 25 for the heat transfer tubes 30B are formed on a pair of straight lines parallel to the axial direction of the header refrigerant distributor 10. In addition, one of the insertion holes 24 and one of the insertion holes 25 adjacent to each other in a direction crossing the axial direction of the header refrigerant distributor 10 are formed to be arranged in the plane perpendicular to a refrigerant flow direction denoted with arrow 80 in FIG. 15. In Embodiment 3, the insertion holes 23 of the inner pipe 11 into which the heat transfer tubes 30A are inserted are formed to be arranged in a pair of straight lines parallel to the axial direction of the header refrigerant distributor 10, and to be arranged side by side with the insertion holes 24 and the insertion holes 25 in the plane perpendicular to the refrigerant flow direction.

Figure 16:
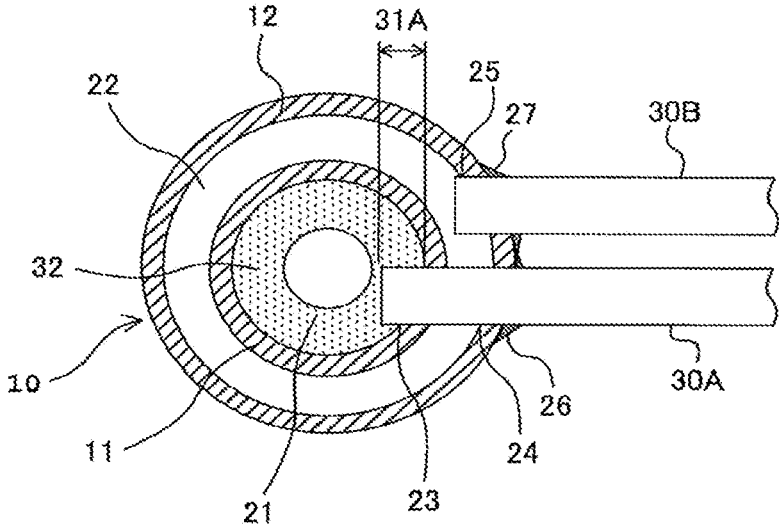
FIG. 16 is a cross-sectional view of a heat transfer tube according to Embodiment 3 inserted into a header refrigerant distributor.

FIG. 16 is a cross-sectional view of heat transfer tubes according to Embodiment 3 inserted into a header refrigerant distributor. FIG. 16 illustrates a cross section of the header refrigerant distributor 10, one of the heat transfer tubes 30A, and one of the heat transfer tubes 30B taken along a plane perpendicular to the center axis of the header refrigerant distributor 10 at a position of the axis of the heat transfer tube 30A. Also in Embodiment 3, an amount of insertion 31A of the heat transfer tubes 30A into the inner pipe 11 is determined to be smaller than or equal to the thickness of the liquid membrane 32 formed on the inner wall of the inner pipe 11. Thus, a liquid refrigerant flowing to the heat transfer tubes 30A is finely distributed, and the heat exchange efficiency is also improved.

Figure 17:
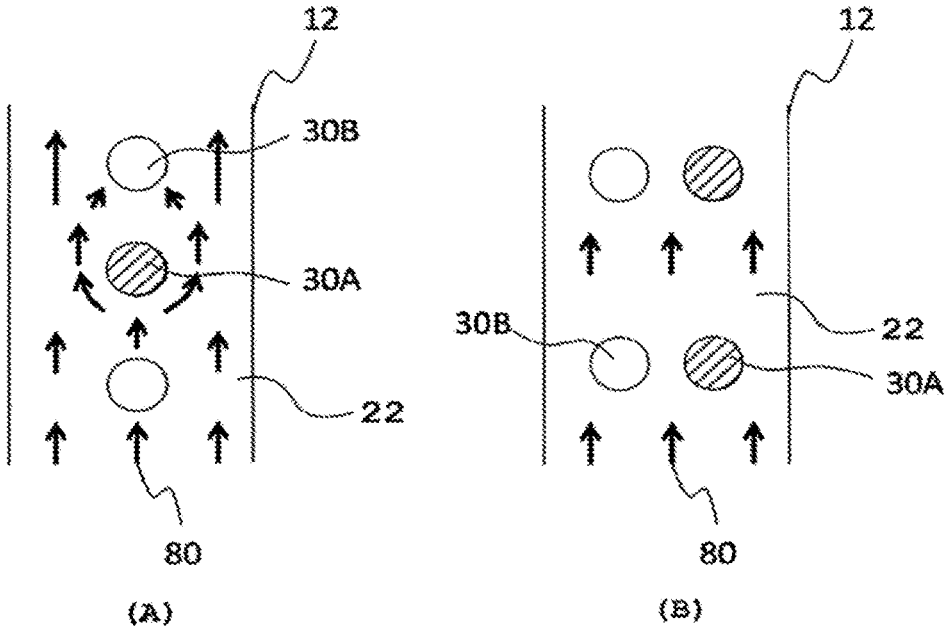
FIG. 17 is a schematic diagram of a liquid refrigerant flowing through an annular flow path.

FIG. 17 is a schematic diagram of a liquid refrigerant flowing through an annular flow path. FIG. 17(A) illustrates a flow of a liquid refrigerant in the annular flow path 22 according to Embodiment 1, and FIG. 17(B) illustrates a flow of a liquid refrigerant in the annular flow path 22 according to Embodiment 3. As described above, in Embodiment 1, the insertion holes 24 for the heat transfer tubes 30A and the insertion holes 25 for the heat transfer tubes 30B are alternately formed on a straight line in the longitudinal direction of the header refrigerant distributor 10. Thus, as illustrated in FIG. 17(A), the heat transfer tubes 30A and the heat transfer tubes 30B are arranged in a straight line. Specifically, each heat transfer tube 30A is disposed between heat transfer tubes 30B adjacent to each other in the refrigerant flow direction. In contrast, in Embodiment 3, the insertion holes 24 for the heat transfer tubes 30A and the insertion holes 25 for the heat transfer tubes 30B are arranged on the plane perpendicular to the refrigerant flow direction. Specifically, as illustrated in FIG. 17(B), the multiple heat transfer tubes 30B connected to the annular flow path 22 are arranged in a straight line without having other heat transfer tubes that block the flow of refrigerant between adjacent heat transfer tubes 30B. Thus, the flow rate of refrigerant that flows into the heat transfer tubes 30B can be increased, and thus, the heat source side heat exchanger 40 can improve its heat exchange efficiency.

Figure 18:
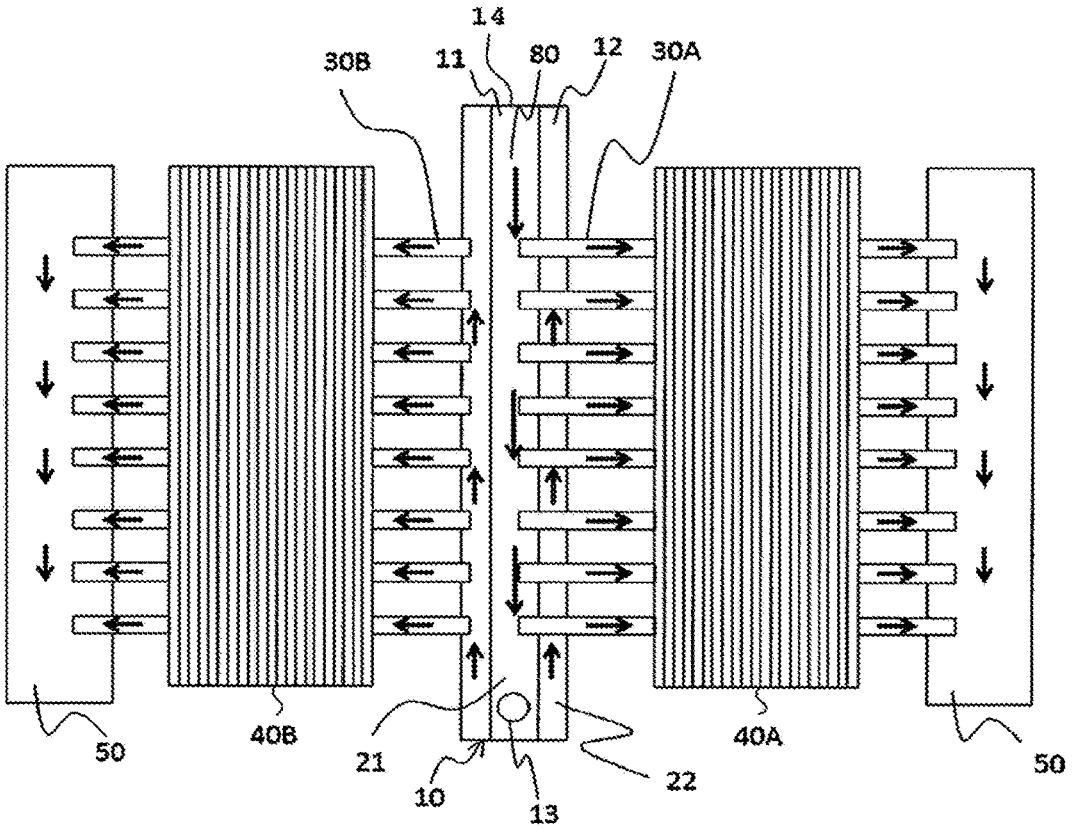
FIG. 18 is a schematic diagram of a structure of a heat source side heat exchanger according to a modification example of Embodiment 3.

FIG. 18 is a schematic diagram of a structure of a heat source side heat exchanger according to a modification example of Embodiment 3. In this modification example, the inlet port 14 into which refrigerant flows is formed at one of both end portions of the inner pipe 11 at an upper portion of the header refrigerant distributor 10. The discharge port 13 that connects the inner pipe flow path 21 and the annular flow path 22 together is formed at one of both end portions of the inner pipe 11 at a lower portion of the header refrigerant distributor 10. The double pipe structure of the header refrigerant distributor 10 effectively improves the heat exchange efficiency of the heat exchanger also when refrigerant flows downward in the inner pipe flow path 21, as illustrated in FIG. 18. Specifically, compared to an existing header refrigerant distributor used for a downward flow, the heat exchanger improves its heat exchange efficiency when the double pipe structure is used for a downward flow as in a modification example of Embodiment 3. The header refrigerant distributor 10 having a double pipe structure is effective to a header refrigerant distributor having an existing structure regardless of whether the refrigerant flows either upward or downward in the inner pipe flow path 21.

Embodiment 4

Figure 19:
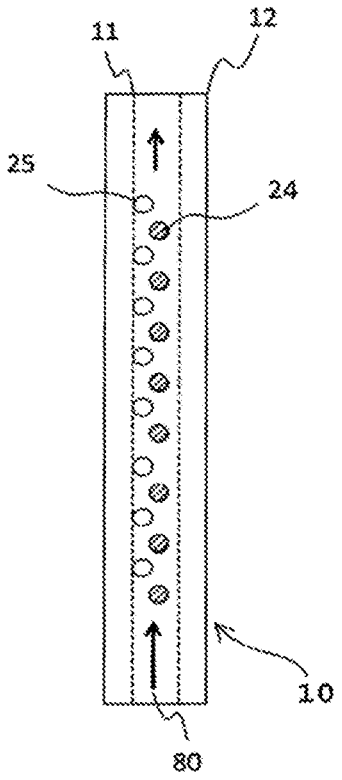
FIG. 19 is a schematic diagram of the positional relationship between an inner pipe, an outer pipe, and insertion holes of a header refrigerant distributor according to Embodiment 4 of the present invention.

Embodiment 4 of the present invention will be described below with reference to FIG. 19 to FIG. 22. In FIG. 19 to FIG. 22, components the same as or equivalent to those in Embodiments 1 to 3 are denoted with the same reference signs, and components the same as those in Embodiments 1 to 3 will not be fully described. Embodiment 4 differs from Embodiment 2 in the arrangement of the heat transfer tubes 30A and the heat transfer tubes 30B. FIG. 19 is a schematic diagram of the positional relationship between an inner pipe, an outer pipe, and insertion holes of a header refrigerant distributor according to Embodiment 4 of the present invention. In FIG. 19, for ease of understanding, the position of the inner pipe 11 inside the header refrigerant distributor 10 is expressed with dotted lines. In FIG. 19, to clearly illustrate the arrangement of the insertion holes 24 and the insertion holes 25, only the insertion holes 24 are hatched. The outer pipe 12 has multiple insertion holes 24 and multiple insertion holes 25. The heat transfer tubes 30A connected to the heat exchanger core 40A on the windward side are inserted into the insertion holes 24, and the heat transfer tubes 30B connected to the heat exchanger core 40B on the leeward side are inserted into the insertion holes 25. As illustrated in FIG. 19, the multiple insertion holes 24 and the multiple insertion holes 25 are misaligned with each other in the refrigerant flow direction denoted with arrow 80, and misaligned with each other in the direction perpendicular to the refrigerant flow direction to be arranged in a zigzag manner. In other words, the multiple insertion holes 24 and the multiple insertion holes 25 are formed on a pair of straight lines in the longitudinal direction of the outer pipe 12, which are offset in the longitudinal direction of the outer pipe 12, that is, in the axial direction, and offset in the direction perpendicular to the axial direction of the outer pipe 12. In Embodiment 4, the insertion holes 23 of the inner pipe 11 into which the heat transfer tubes 30A are inserted are formed on a pair of straight lines parallel to the axial direction of the header refrigerant distributor 10 and to be arranged side by side with the insertion holes 24 in the plane perpendicular to the refrigerant flow direction.

Figure 20:
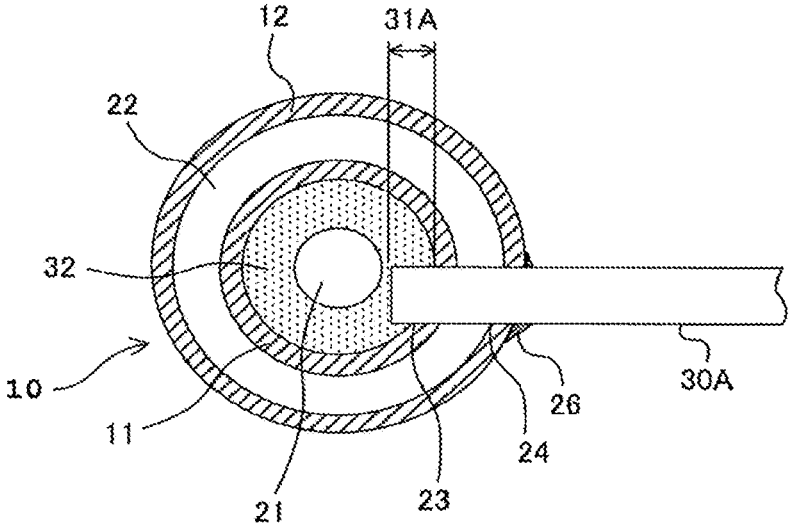
FIG. 20 is a cross-sectional view of a structure of a heat transfer tube according to Embodiment 4 inserted into a header refrigerant distributor.
Figure 21:
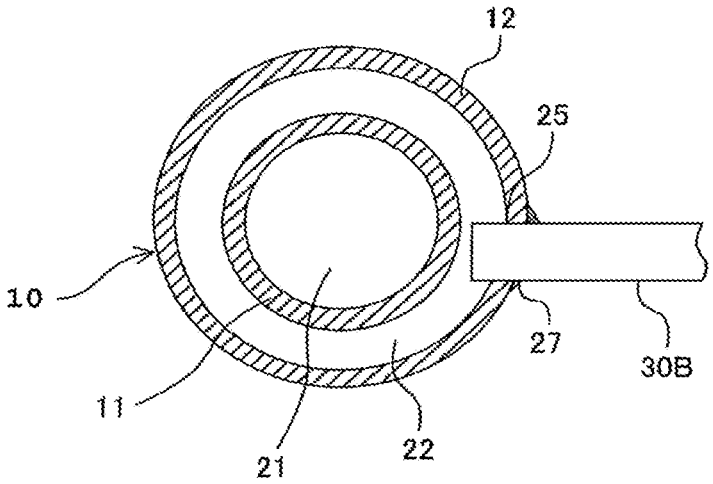
FIG. 21 is a cross-sectional view of a structure of the heat transfer tube according to Embodiment 4 inserted into the header refrigerant distributor.

FIG. 20 and FIG. 21 are cross-sectional views of a structure of a heat transfer tube according to Embodiment 4 inserted into a header refrigerant distributor. FIG. 20 illustrates a cross section of the header refrigerant distributor 10 and one of the heat transfer tubes 30A taken along a plane perpendicular to the center axis of the header refrigerant distributor 10 at a position of the axis of the heat transfer tube 30A. FIG. 21 illustrates a cross section of the header refrigerant distributor 10 and one of the heat transfer tubes 30B taken along a plane perpendicular to the center axis of the header refrigerant distributor 10 at a position of the axis of the heat transfer tube 30B. As in the case of the amount of insertion of the heat transfer tubes 30A according to Embodiment 1, the amount of insertion of each of the heat transfer tubes 30A is a distance from the position of the inner wall of the inner pipe 11 into which the tubes 30A are inserted to the tip position of the inserted heat transfer tube 30A. In Embodiment 4, the amount of insertion 31A of the heat transfer tubes 30A into the inner pipe 11 is smaller than or equal to the thickness of the liquid membrane 32 formed over the inner wall of the inner pipe 11. Thus, a liquid refrigerant flowing to the heat transfer tubes 30A is finely distributed, and the heat exchange efficiency of the heat source side heat exchanger 40 can be also improved.

As illustrated in FIG. 20, the heat transfer tube 30A is disposed at a position closer to the center axes of the inner pipe 11 and the outer pipe 12 than the inner wall surface of the inner pipe 11. As illustrated in FIG. 21, the heat transfer tube 30B is disposed at a position closer to the center axes of the inner pipe 11 and the outer pipe 12 than the inner wall surface of the outer pipe 12. Specifically, in Embodiment 4, the insertion holes 23 and the insertion holes 24 are formed so that the inserted heat transfer tubes 30A are positioned closer to the center axis than the outer peripheral surface of the header refrigerant distributor 10. The insertion holes 25 are formed so that the inserted heat transfer tubes 30B are positioned closer to the center axis than the outer peripheral surface of the header refrigerant distributor 10. This structure can increase the flow rate of a liquid refrigerant flowing to the heat transfer tubes 30A connected to the inner pipe flow path 21 and increase the flow rate of a liquid refrigerant flowing to the heat transfer tubes 30B connected to the annular flow path 22, so that the heat source side heat exchanger 40 improves its heat exchange efficiency.

Figure 22:
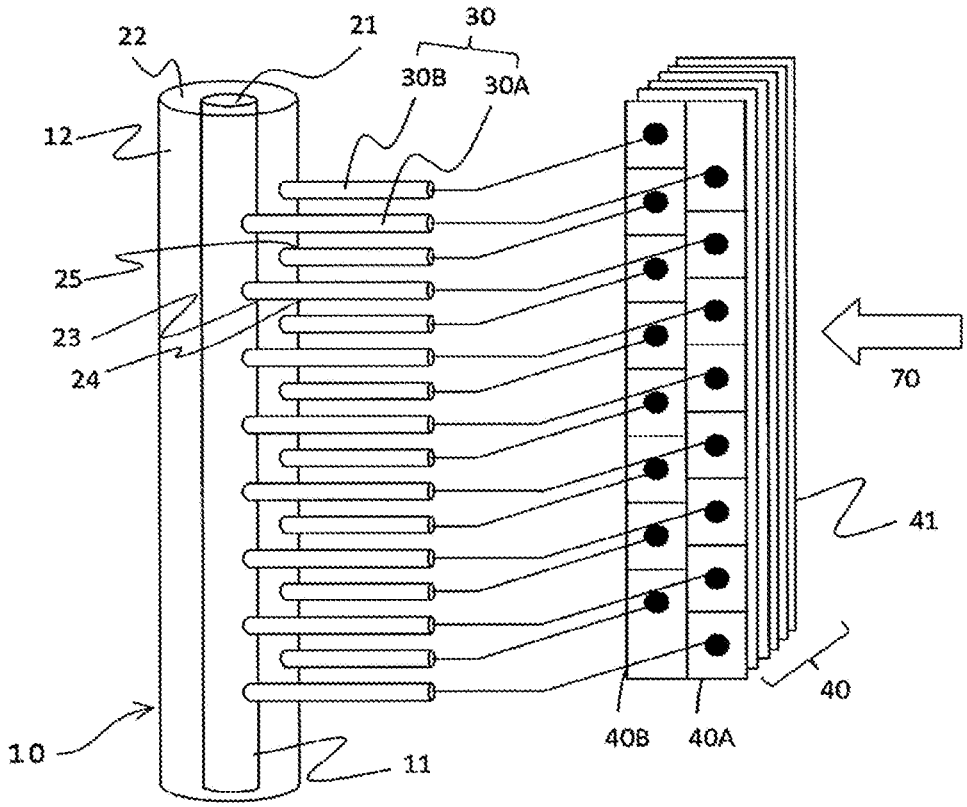
FIG. 22 is a schematic diagram of a structure of a header refrigerant distributor according to Embodiment 4.

FIG. 22 is a schematic diagram of a structure of a header refrigerant distributor according to Embodiment 4. The above structure of the header refrigerant distributor 10 according to Embodiment 4 is particularly preferable when, as illustrated in FIG. 22, the positions of the heat transfer tubes of the heat exchanger core 40A in the first row are vertically misaligned with the positions of the heat transfer tubes of the heat exchanger core 40B in the second row when viewed in an air flow direction denoted with arrow 70.

Embodiment 5

Figure 23:
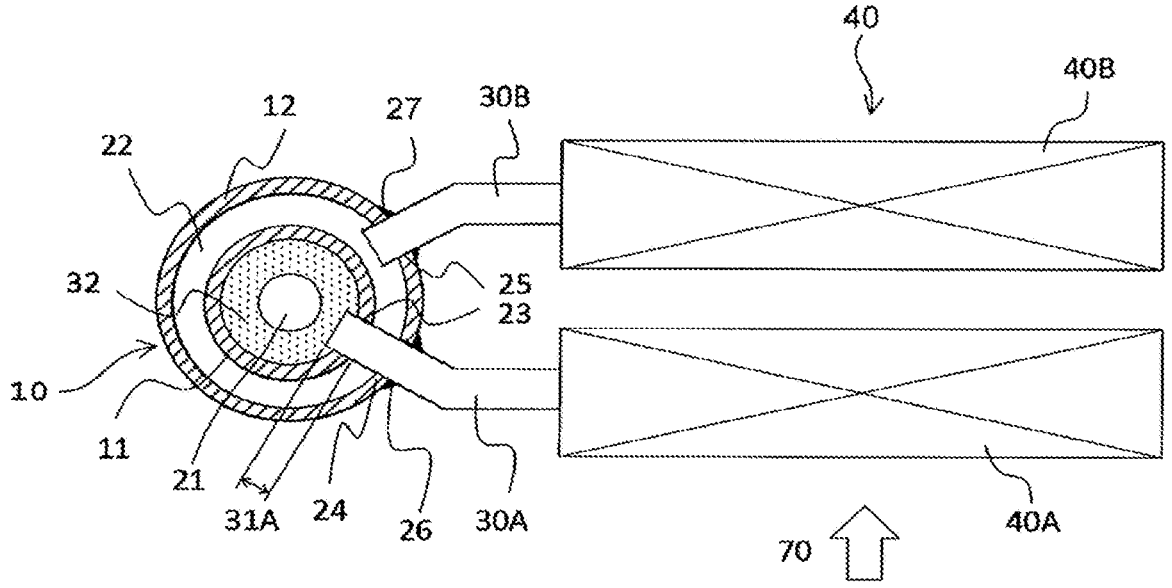
FIG. 23 illustrates a structure of a heat transfer tube according to Embodiment 5 of the present invention inserted into a header refrigerant distributor.

Embodiment 5 of the present invention will now be described with reference to FIG. 23. FIG. 23 illustrates a structure of a heat transfer tube according to Embodiment 5 of the present invention inserted into a header refrigerant distributor. In FIG. 23, components the same as or equivalent to those in Embodiments 1 to 4 are denoted with the same reference signs, and components the same as those in Embodiments 1 to 4 will not be fully described. FIG. 23 illustrates a cross section of the header refrigerant distributor 10 taken along a plane perpendicular to the center axis of the header refrigerant distributor 10 at a position of the axis of one of the multiple heat transfer tubes 30A.

As in the case of Embodiments 1 to 4, the header refrigerant distributor 10 according to Embodiment 5 includes an inner pipe 11 and an outer pipe 12, and has a double pipe structure. The header refrigerant distributor 10 includes an inner pipe flow path 21 and an annular flow path 22 to serve as refrigerant flow paths through which refrigerant flows. The inner pipe flow path 21 is defined by the inner side of the inner pipe 11. The annular flow path 22 is defined by the outer side of the inner pipe 11 and the inner side of the outer pipe 12, and has an annular cross section. The heat source side heat exchanger 40 includes a heat exchanger core 40A and a heat exchanger core 40B. The insertion holes 23 to 25 are formed at positions the same as those according to Embodiment 3. When the heat source side heat exchanger 40 operates as an evaporator, a two-phase gas-liquid refrigerant flows into the header refrigerant distributor 10. To improve the heat exchange efficiency, the amount of insertion 31A of the heat transfer tubes 30A is preferably smaller than or equal to the thickness of the liquid membrane 32 formed over the inner wall of the inner pipe 11. In Embodiment 5, the multiple heat transfer tubes 30A are inserted into the inner pipe 11 through the insertion holes 23, and are directed to the center axis of the header refrigerant distributor 10 while being inserted into the outer pipe 12 through the insertion holes 24. The multiple heat transfer tubes 30B are directed to the center axis of the header refrigerant distributor 10 while being inserted into the outer pipe 12 through the insertion holes 25. Specifically, the insertion holes 23 and the insertion holes 24 are formed so that, when the heat transfer tubes 30A are inserted into the insertion holes 23 and the insertion holes 24, the center axes of the inner pipe 11 and the outer pipe 12 are located in a direction of extensions of the heat transfer tubes 30A. The insertion holes 25 are formed so that, when the heat transfer tubes 30B are inserted into the insertion holes 25, the center axes of the inner pipe 11 and the outer pipe 12 are located in a direction of extensions of the heat transfer tubes 30B.

The above structure improves the workability of assembling a heat exchanger, and the workability of soldering the heat transfer tubes 30A and the heat transfer tubes 30B, so that a high-quality highly-reliable heat exchanger can be obtained. In addition, the amount of insertion 31A of the heat transfer tubes 30A can be easily adjusted to be smaller than or equal to the thickness of the liquid membrane 32 formed over the inner wall of the inner pipe 11. Thus, as described above, the heat source side heat exchanger 40 can improve its heat exchange efficiency.

Embodiment 6

Figure 24:
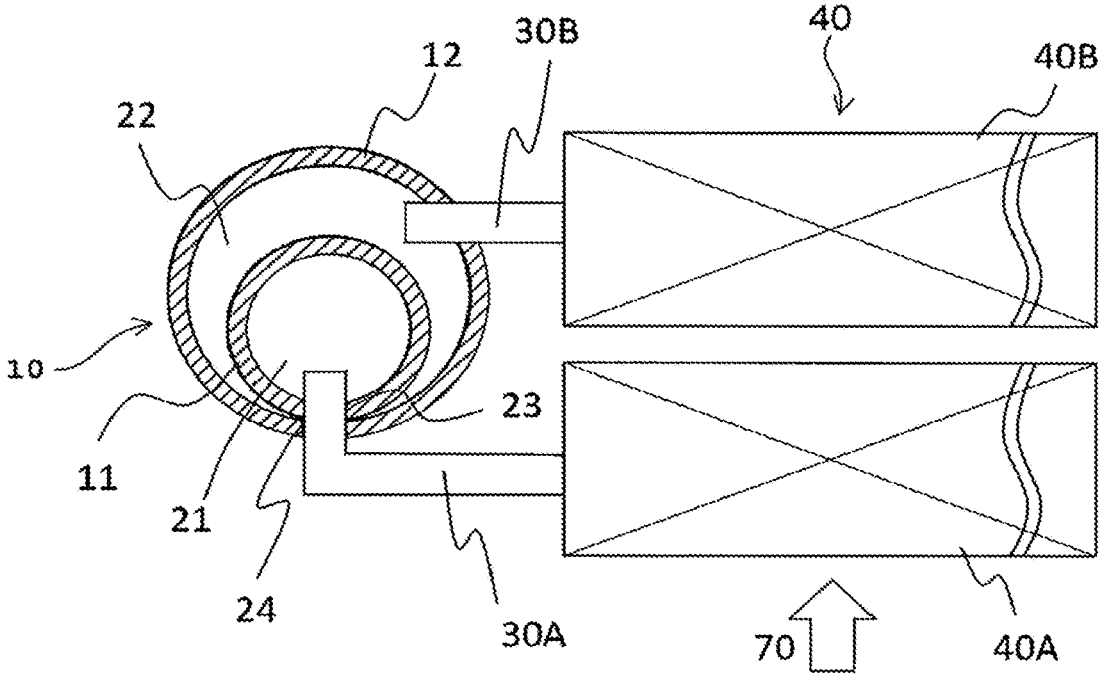
FIG. 24 illustrates a structure of a heat transfer tube according to Embodiment 6 of the present invention inserted into a header refrigerant distributor.

Embodiment 6 of the present invention will now be described with reference to FIG. 24. FIG. 24 illustrates a structure of a heat transfer tube according to Embodiment 6 of the present invention inserted into a header refrigerant distributor. In FIG. 24, components the same as or equivalent to those in Embodiments 1 to 5 are denoted with the same reference signs, and components the same as those in Embodiments 1 to 5 will not be fully described. FIG. 24 illustrates a cross section of the header refrigerant distributor 10 taken along a plane perpendicular to the center axis of the header refrigerant distributor 10 at a position of the axis of one of the multiple heat transfer tubes 30A.

As illustrated in FIG. 24, the header refrigerant distributor 10 has a double pipe structure including an inner pipe 11 and an outer pipe 12. The center axis of the inner pipe 11 is eccentric relative to the center axis of the outer pipe 12, and part of the outer peripheral surface of the inner pipe 11 is located adjacent to part of the inner peripheral surface of the outer pipe 12. The positions of the insertion holes 23 to 25 are the same as those in Embodiment 3. In Embodiment 6, the inner pipe 11 has insertion holes 23 and the outer pipe 12 has the insertion holes 24 in the areas in which the inner pipe 11 and the outer pipe 12 are located adjacent to each other. Specifically, in Embodiment 6, the insertion holes 23 and the insertion holes 24 for the heat transfer tubes 30A are disposed in series.

The above structure allows the heat transfer tubes 30A to be easily inserted into the insertion holes 23 and the insertion holes 24, and improves the workability in assembly. The arrangement of the inner pipe 11 having it outer side located adjacent to and in contact with the inner side of the outer pipe 12 prevents the amount of insertion of the heat transfer tubes 30A from varying. Thus, a high-quality heat exchanger can be provided.

In Embodiments 5 and 6, the insertion holes 23 to 25 are formed to be arranged in the plane perpendicular to the refrigerant flow direction, but may be arranged in another form. As illustrated in FIG. 19, Embodiments 5 and 6 are also applicable to a structure where the insertion holes 24 and the insertion holes 25 are arranged in a zigzag form, and the insertion holes 23 and the insertion holes 24 are arranged side by side in the plane perpendicular to the refrigerant flow direction.

Embodiment 7

Figure 25:
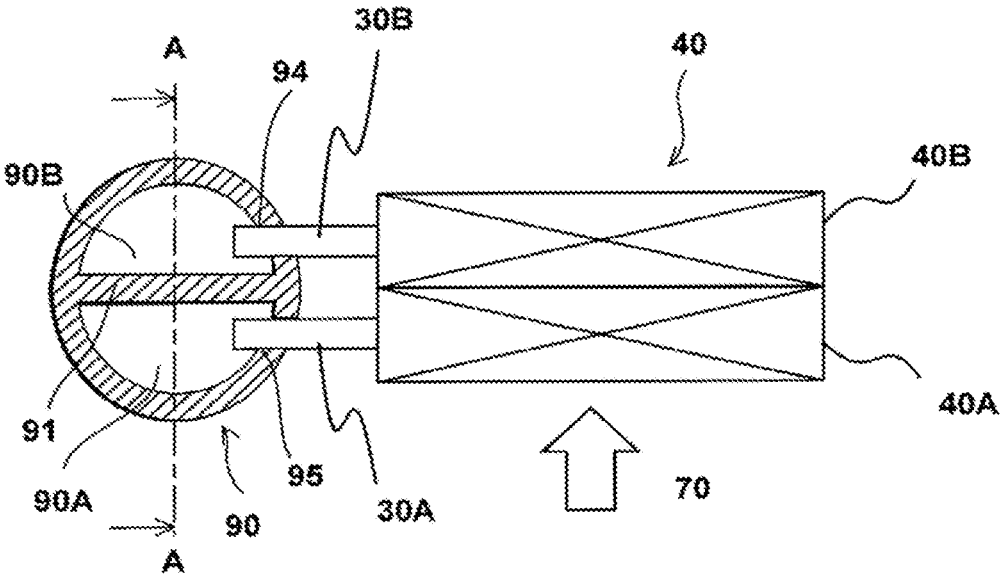
FIG. 25 illustrates a structure of a heat transfer tube according to Embodiment 7 of the present invention, and a heat transfer tube inserted into the header refrigerant distributor.
Figure 26:
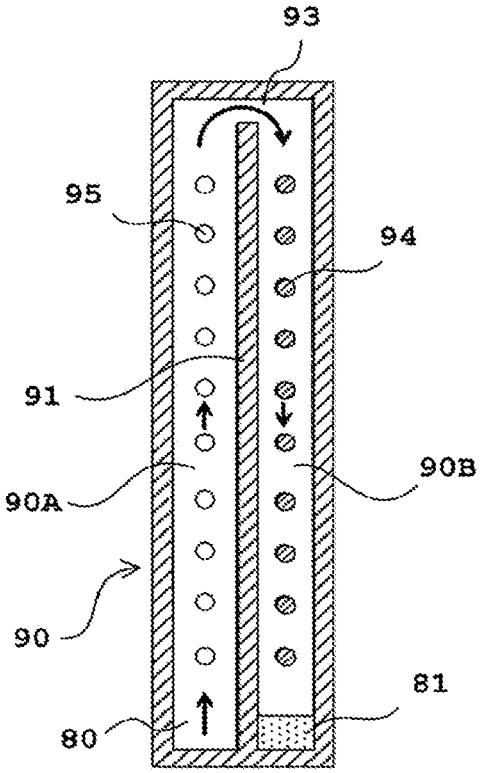
FIG. 26 is a schematic, vertically-cross-sectional view of a header refrigerant distributor according to Embodiment 7.

Embodiment 7 of the present invention will now be described with reference to FIG. 25 to FIG. 31. In FIG. 25 to FIG. 31, components the same as or equivalent to those in Embodiments 1 to 6 are denoted with the same reference signs, and components the same as those in Embodiments 1 to 6 will not be fully described. A header refrigerant distributor 90 according to Embodiment 7 differs from the header refrigerant distributor 10 according to Embodiment 1 to Embodiment 6 in that it has a structure other than a double pipe structure. FIG. 25 illustrates a structure of a header refrigerant distributor according to Embodiment 7 of the present invention and a heat transfer tube inserted into the header refrigerant distributor. FIG. 26 is a schematic, vertically-cross-sectional view of a header refrigerant distributor according to Embodiment 7. FIG. 25 illustrates a cross section of the header refrigerant distributor 90 taken along a plane perpendicular to the center axis of the header refrigerant distributor 90 at a position of the axis of one of the multiple heat transfer tubes 30A. FIG. 26 illustrates a schematic cross section of the header refrigerant distributor 90 taken in the longitudinal direction along line A-A in FIG. 25 and viewed in a direction of arrow in FIG. 25.

As illustrated in FIG. 25 and FIG. 26, the header refrigerant distributor 90 according to Embodiment 7 is a pipe-shaped member and includes a partitioning wall 91 therein. The partitioning wall 91 extends from an end portion of the header refrigerant distributor 90 on the bottom surface toward an end portion of the header refrigerant distributor 90 on the upper surface in the longitudinal direction of the header refrigerant distributor 90. The inside of the header refrigerant distributor 90 is divided into a first chamber 90A and a second chamber 90B by the partitioning wall 91. In the first chamber 90A, an inlet port for refrigerant is formed at the end portion of the header refrigerant distributor 90 closer to the bottom surface. In the second chamber 90B, a lower end portion of the header refrigerant distributor 90 has a bottom surface. A gap is formed between the upper surface of the header refrigerant distributor 90 and the end portion of the partitioning wall 91 closer to the upper surface of the header refrigerant distributor 90 to form a discharge port 93. In other words, the partitioning wall 91 has an end portion closer to the upper surface of the header refrigerant distributor 10 partially removed not to come into contact with the upper surface of the header refrigerant distributor 10. Thus, the first chamber 90A and the second chamber 90B are connected through the discharge port 93 at the end portion closer to the upper surface of the header refrigerant distributor 10.

Multiple insertion holes 95 are formed in the side surface of the first chamber 90A, and multiple insertion holes 94 are formed in the side surface of the second chamber 90B. In FIG. 26, to clearly illustrate the positions of the insertion holes 94 and the insertion holes 95, only the insertion holes 94 are hatched. The multiple insertion holes 94 and the multiple insertion holes 95 are arranged while being spaced apart from each other in the longitudinal direction of the header refrigerant distributor 90. The heat transfer tubes 30A of the heat exchanger core 40A in a first row, that is, on the windward side are respectively inserted into the multiple insertion holes 95. The heat transfer tubes 30B of the heat exchanger core 40B in a second row, that is, on the leeward side are respectively inserted into the multiple insertion holes 94.

A two-phase gas-liquid refrigerant flows into the first chamber 90A in a direction of arrow 80 from the bottom surface of the header refrigerant distributor 90. Then, a liquid refrigerant is fed from the first chamber 90A to the heat exchanger core 40A in the first row through the heat transfer tubes 30A. The remaining two-phase gas-liquid refrigerant flows from the first chamber 90A into the second chamber 90B through the discharge port 93. Thereafter, a liquid refrigerant is fed from the second chamber 90B to the heat exchanger core 40B in the second row through the heat transfer tubes 30B. A lubricating oil 81 for a compressor 110 contained in a liquid refrigerant that has flowed down through the second chamber 90B accumulates in a bottom portion of the second chamber 90B. The above structure can achieve the same effects as those according to Embodiment 1. Embodiment 7 facilitates an assembly, by simply inserting both the heat transfer tubes 30A and the heat transfer tubes 30B into the side surface of the header refrigerant distributor 90.

Figure 27:
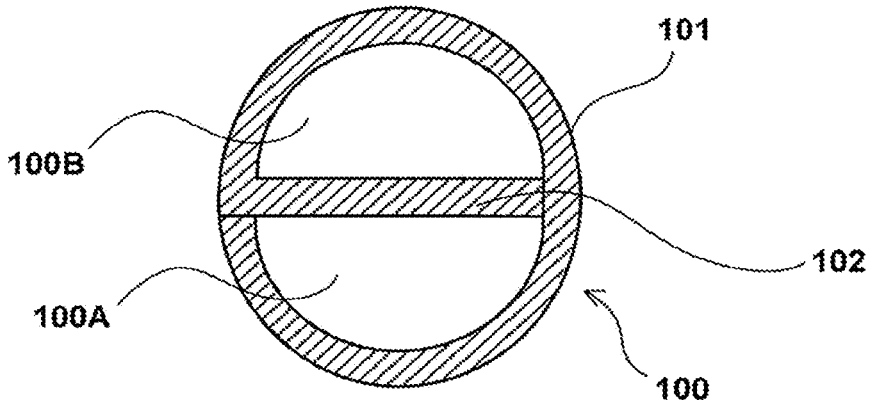
FIG. 27 is a schematic, laterally-cross-sectional view of a header refrigerant distributor of a first modification example of Embodiment 7.

FIG. 27 is a schematic, laterally-cross-sectional view of a header refrigerant distributor of a first modification example of Embodiment 7. As illustrated in FIG. 27, a header refrigerant distributor 100 of a first modification example is formed by bending a single cladding member. A hollow cylinder portion 101 is formed from a plate-shaped cladding member, a first end portion of the cladding member is bent to the inner portion of the hollow cylinder portion 101, and the end surface of the cladding member is in contact with the inner peripheral surface of the hollow cylinder portion 101 opposing a bent portion. The bent end portion forms a partitioning wall 102. The partitioning wall 102 divides the inside of the hollow cylinder portion 101 into a first chamber 100A and a second chamber 100B. Although not illustrated in FIG. 27, insertion holes are formed in the side surface of the first chamber 100A and the side surface of the second chamber 100B. In the first modification example, a header refrigerant distributor is formed from a single cladding member, so that a high-performance header refrigerant distributor can be obtained at low costs.

Figure 28:
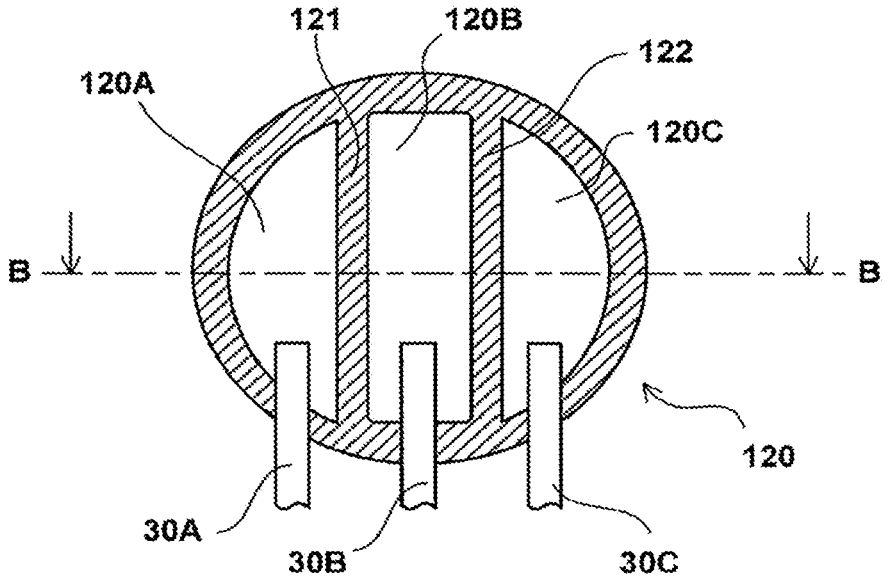
FIG. 28 is a schematic, laterally-cross-sectional view of a header refrigerant distributor of a second modification example of Embodiment 7.
Figure 29:
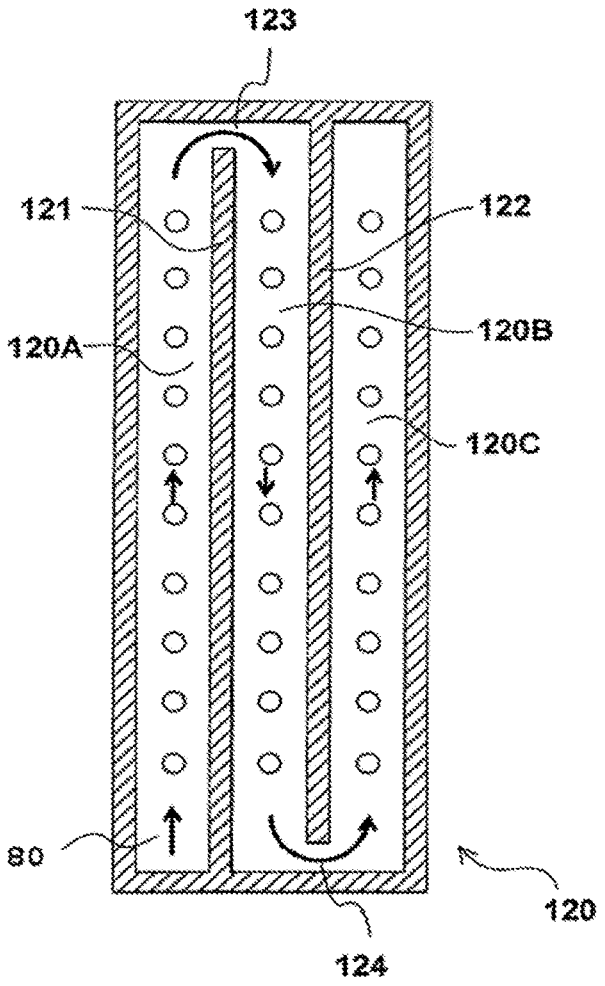
FIG. 29 is a schematic, laterally-cross-sectional view of the header refrigerant distributor of the second modification example of Embodiment 7.

FIG. 28 illustrates a structure of a header refrigerant distributor of a second modification example of Embodiment 7, and heat transfer tubes inserted into the header refrigerant distributor. FIG. 29 is a schematic, laterally-cross-sectional view of the header refrigerant distributor of the second modification example. FIG. 28 illustrates a cross section of a header refrigerant distributor 120 taken along a plane perpendicular to the center axis of the header refrigerant distributor 120 at a position of the axis of one of multiple heat transfer tubes 30A. FIG. 29 illustrates a schematic cross section of the header refrigerant distributor 120 taken in the longitudinal direction along line B-B in FIG. 28 and viewed in a direction of arrow in FIG. 28. The header refrigerant distributor 120 is a pipe-shaped member, and includes a partitioning wall 121 and a partitioning wall 122 inside. The partitioning wall 121 and the partitioning wall 122 are spaced apart from each other to extend parallel to each other in the longitudinal direction of the header refrigerant distributor 120. The side surface of the header refrigerant distributor 120 and the partitioning wall 121 define a first chamber 120A, the partitioning wall 121 and the partitioning wall 122 define a second chamber 120B, and the side surface of the header refrigerant distributor 120 and the partitioning wall 122 define a third chamber 120C. At the end portion of the header refrigerant distributor 120 closer to the upper surface, a gap is formed between the partitioning wall 121 and the upper surface of the header refrigerant distributor 120 to form a discharge port 123, with which the first chamber 120A and the second chamber 120B are connected together. At the end portion of the header refrigerant distributor 120 closer to the bottom surface, a gap is formed between the partitioning wall 122 and the bottom surface of the header refrigerant distributor 120 to form a discharge port 124, with which the second chamber 120B and the third chamber 120C are connected. The heat transfer tube 30A is connected to the first chamber 120A, the heat transfer tube 30B is connected to the second chamber 120B, and the heat transfer tube 30C is connected to the third chamber 120C. The header refrigerant distributor 120 is employed in a heat source side heat exchanger including heat exchanger cores in three rows.

The header refrigerant distributor according to Embodiment 7 is not limited to have a structure in which the inside of the pipe-shaped member is divided into two or three spaces. The inside of the header refrigerant distributor of the pipe-shaped member may be divided by partitioning walls into an appropriate number of spaces in accordance with the number of rows of heat source exchanger cores of a heat source exchanger.

Figure 30:
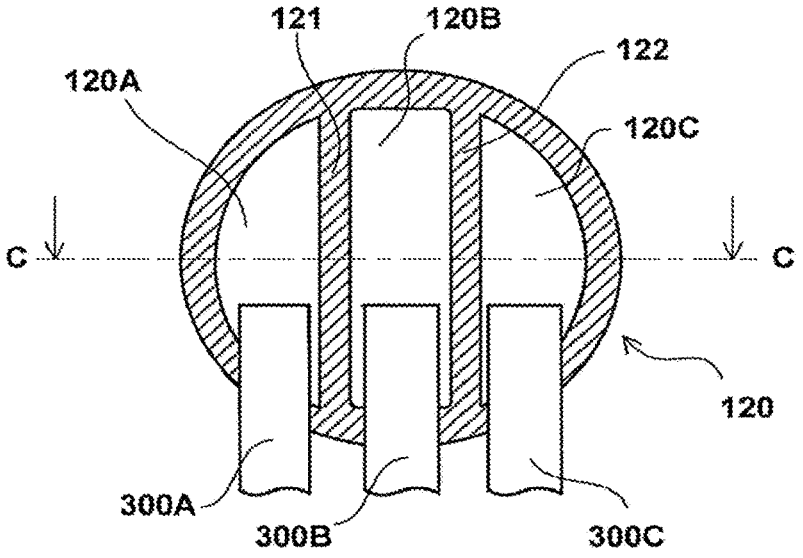
FIG. 30 is a schematic, vertically-cross-sectional view of a header refrigerant distributor of a third modification example of Embodiment 7.
Figure 31:
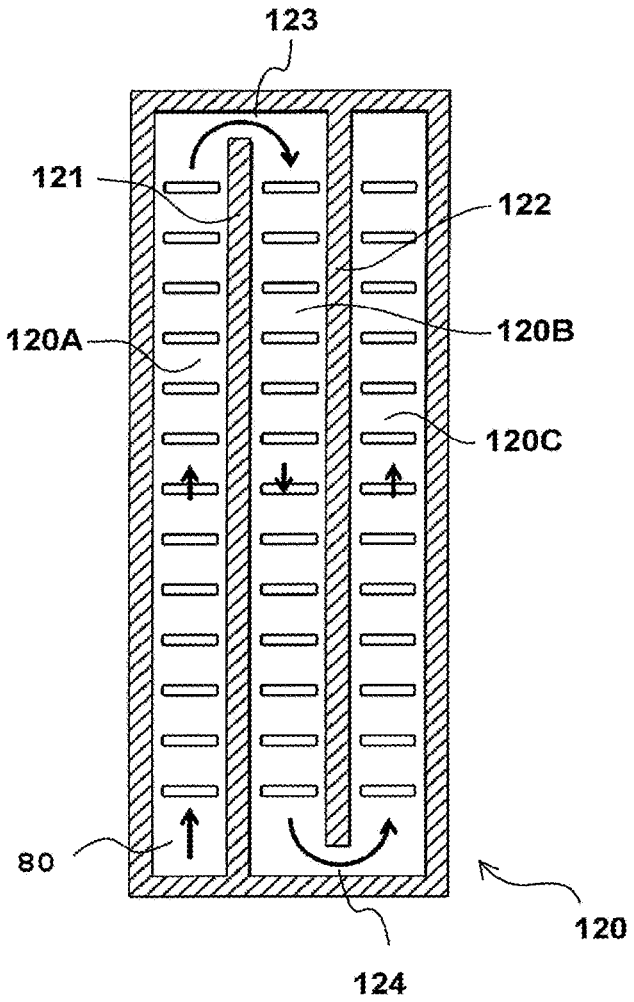
FIG. 31 is a schematic, laterally-cross-sectional view of a header refrigerant distributor of the third modification example of Embodiment 7.

FIG. 30 illustrates a structure of a header refrigerant distributor of a third modification example of Embodiment 7, and heat transfer tubes inserted into the header refrigerant distributor. FIG. 31 is a schematic, laterally-cross-sectional view of a header refrigerant distributor of the third modification example. FIG. 30 illustrates a cross section of the header refrigerant distributor 90 taken along a plane perpendicular to the center axis of the header refrigerant distributor 90 at a position of the axis of one of multiple heat transfer tubes 300A. FIG. 31 illustrates a schematic cross section of the header refrigerant distributor 120 taken in the longitudinal direction along line C-C in FIG. 30 and viewed in a direction of arrow in FIG. 30. In FIG. 30 and FIG. 31, components the same as or equivalent to those of the second modification example in Embodiment 7 are denoted with the same reference signs as those in FIG. 28 and FIG. 29. As illustrated in FIG. 30 and FIG. 31, heat transfer tubes 300A, 300B, and 300C connected to the header refrigerant distributor 120 are flat pipes. Other components are the same as those in the second modification example.

Embodiment 8

Figure 32:
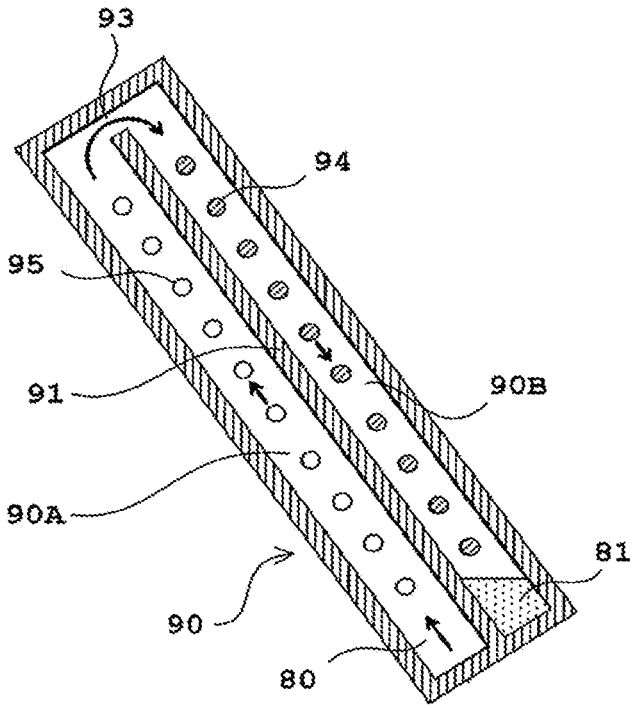
FIG. 32 is a schematic, vertically-cross-sectional view of a header refrigerant distributor according to Embodiment 8 of the present invention.
Figure 33:
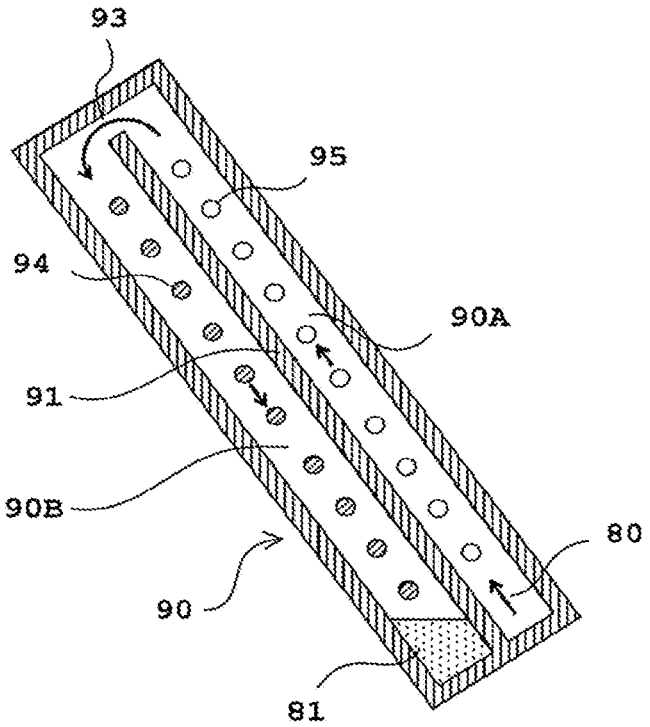
FIG. 33 is a schematic, vertically-cross-sectional view of a header refrigerant distributor according to Embodiment 8 of the present invention.

Embodiment 8 of the present invention will now be described with reference to FIG. 32 and FIG. 33. FIG. 32 and FIG. 33 are schematic, vertically-cross-sectional views of a header refrigerant distributor according to Embodiment 8 of the present invention. Vertical cross sections of the header refrigerant distributor 90 illustrated in FIG. 32 and FIG. 33 are cross sections of the header refrigerant distributor 90 taken at the same position as that of FIG. 26. In FIG. 32 and FIG. 33, components the same as or equivalent to those in Embodiments 1 to 7 are denoted with the same reference signs, and components the same as those in Embodiments 1 to 7 will not be fully described. The effects of the present invention can be also obtained from the header refrigerant distributor 90 disposed so that its longitudinal direction is inclined relative to the vertical direction, as illustrated in FIG. 32 and FIG. 33. FIG. 32 and FIG. 33 illustrate the header refrigerant distributor 90, which is an annular member including a partitioning wall 91 inside as described in Embodiment 7. In FIG. 32, the first chamber 90A is disposed on the lower side, and the second chamber 90B is disposed on the upper side. In FIG. 33, the first chamber 90A is disposed on the upper side, and the second chamber 90B is disposed on the lower side. The header refrigerant distributor 10 according to Embodiment 1 having a double pipe structure may also be disposed to have its longitudinal direction extending in the horizontal direction, or its longitudinal direction inclined relative to the vertical direction. An example use according to Embodiment 8 particularly assumable is a heat exchanger core of an indoor unit.

Embodiment 9

Figure 34:
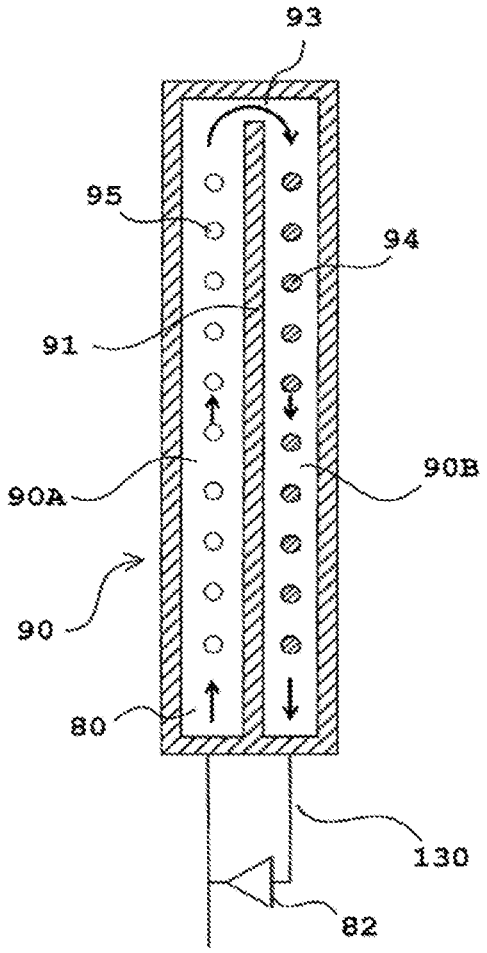
FIG. 34 is a schematic, vertically-cross-sectional view of a header refrigerant distributor according to Embodiment 9 of the present invention.

Embodiment 9 of the present invention will now be described with reference to FIG. 34. FIG. 34 is a schematic, vertically-cross-sectional view of a header refrigerant distributor according to Embodiment 9 of the present invention. A vertical cross section of the header refrigerant distributor 90 illustrated in FIG. 34 is a cross section of the header refrigerant distributor 90 taken at the same position as that in FIG. 26. In FIG. 34, components the same as or equivalent to those in Embodiments 1 to 8 are denoted with the same reference signs, and components the same as those in Embodiments 1 to 8 will not be fully described. When the heat source side heat exchanger 40 operates as a condenser, as illustrated in FIG. 26, in the header refrigerant distributor 90 according to Embodiment 7, the lubricating oil 81 for the compressor 110 mixed in the refrigerant is assumed to accumulate on the lower side of the refrigerant flow path in the direction of gravity. In Embodiment 9, as illustrated in FIG. 34, a bypass 130 is disposed below the header refrigerant distributor 90 in the direction of gravity. The bypass 130 has a first end portion connected to the inlet port of the first chamber 90A, and a second end portion connected to the bottom surface of the second chamber 90B. The bypass 130 connects the first chamber 90A and the second chamber 90B to each other. The bypass 130 includes a check valve 82 that prevents a fluid from flowing from the first chamber 90A to the second chamber 90B. In this structure, a lubricating oil contained in the refrigerant that has flowed down through the second chamber 90B is returned to the inlet port of the first chamber 90A through the check valve 82. Then, the lubricating oil is returned from the first chamber 90A to the heat transfer tubes 30A inserted into the insertion holes 95, or from the second chamber 90B to the heat transfer tubes 30B inserted into the insertion holes 94. This structure thus prevents the lubricating oil from accumulating on the bottom surface of the second chamber 90B, and returns the lubricating oil to the refrigerant cycle of the refrigeration cycle apparatus 1. The compressor 110 can thus improve its reliability.

Embodiment 10

Figure 35:
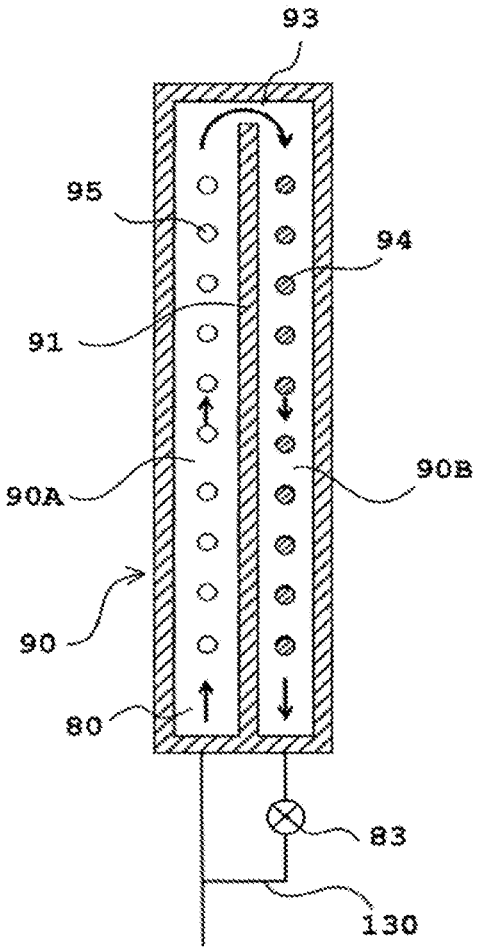
FIG. 35 is a schematic, vertically-cross-sectional view of a header refrigerant distributor according to Embodiment 10 of the present invention.

Embodiment 10 of the present invention will now be described with reference to FIG. 35. FIG. 35 is a schematic, vertically-cross-sectional view of a header refrigerant distributor according to Embodiment 10 of the present invention. A vertical cross section of the header refrigerant distributor 90 illustrated in FIG. 35 is a cross section of the header refrigerant distributor 90 taken at the same position as that in FIG. 26. In FIG. 35, components the same as or equivalent to those in Embodiments 1 to 9 are denoted with the same reference signs, and components the same as those in Embodiments 1 to 9 will not be fully described. Embodiment 10 differs from Embodiment 9 in that the bypass 130 includes a linear expansion valve (LEV) 83, that is, a linear electronic expansion valve, instead of the check valve 82 according to Embodiment 9. The LEV 83 is controlled depending on the operation state to be closed when the heat exchanger operates as an evaporator and to be opened when the heat exchanger operates as a condenser. As in Embodiment 9, when the heat source side heat exchanger 40 operates as a condenser, a lubricating oil for the compressor 110 is prevented from accumulating on the bottom surface of the second chamber 90B, so that the compressor 110 improves its reliability. In addition, when the heat exchanger operates as a condenser, opening or closing of the LEV 83 is controlled to optimally distribute refrigerant between the heat exchanger core 40A in the first row and the heat exchanger core 40B in the second row. Thus, the heat source side heat exchanger 40 can improve its heat exchange efficiency.

As in the case of Embodiment 7, the header refrigerant distribution pipe having an inside divided into the first chamber 90A and the second chamber 90B by the partitioning wall 91 has been described by way of example in Embodiments 9 and 10, but this is not the only possible example. A header refrigerant distributor 10 having a double pipe structure similar to that according to Embodiment 1 may also include a similar bypass.

Embodiment 11

Figure 36:
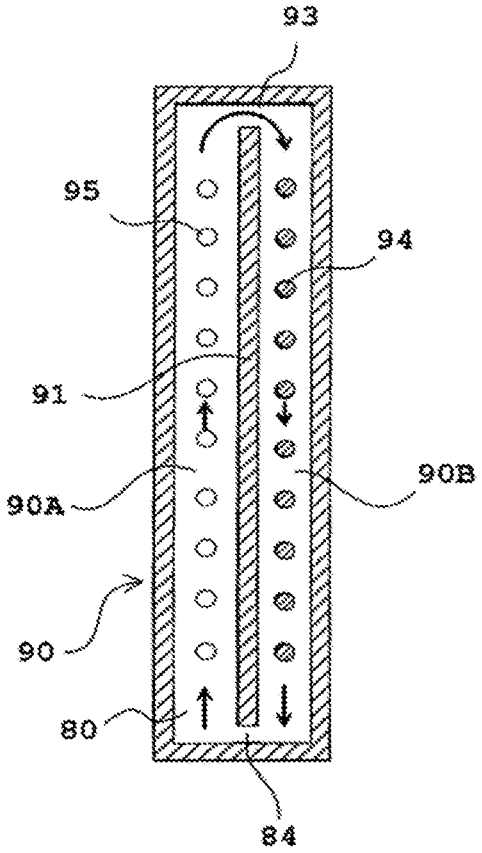
FIG. 36 is a schematic, vertically-cross-sectional view of a header refrigerant distributor according to Embodiment 11 of the present invention.

Embodiment 11 of the present invention will now be described with reference to FIG. 36. FIG. 36 is a schematic, vertically-cross-sectional view of a header refrigerant distributor according to Embodiment 11 of the present invention. A vertical cross section of the header refrigerant distributor 90 illustrated in FIG. 36 is a cross section of the header refrigerant distributor 90 taken at the same position as that in FIG. 26. In FIG. 36, components the same as or equivalent to those in Embodiments 1 to 10 are denoted with the same reference signs, and components the same as those in Embodiments 1 to 10 will not be fully described. As illustrated in FIG. 36, the partitioning wall 91 has an oil outlet 84 at the end portion closer to the bottom surface of the header refrigerant distributor 10. The oil outlet 84 is an opening that connects multiple refrigerant flow paths formed at a lower end portion, in the direction of gravity, of the distributor in an embodiment of the present invention. This oil outlet 84 allows the lubricating oil contained in the refrigerant flowing down through the second chamber 90B to be returned to the first chamber 90A through the oil outlet 84. Thereafter, the lubricating oil is returned from the first chamber 90A to the heat transfer tubes 30A inserted into the insertion holes 95 or from the second chamber 90B to the heat transfer tubes 30B inserted into the insertion holes 94. Thus, the lubricating oil is returned to the refrigerant cycle of the refrigeration cycle apparatus 1 without accumulating on the bottom surface of the second chamber 90B. Thus, the compressor 110 can improve its reliability. Embodiment 11 is easily manufactured by simply forming the oil outlet 84 in the partitioning wall 91, so that a high-quality header refrigerant distributor that prevents the lubricating oil from accumulating can be obtained at low costs.

Embodiment 12

Figure 37:
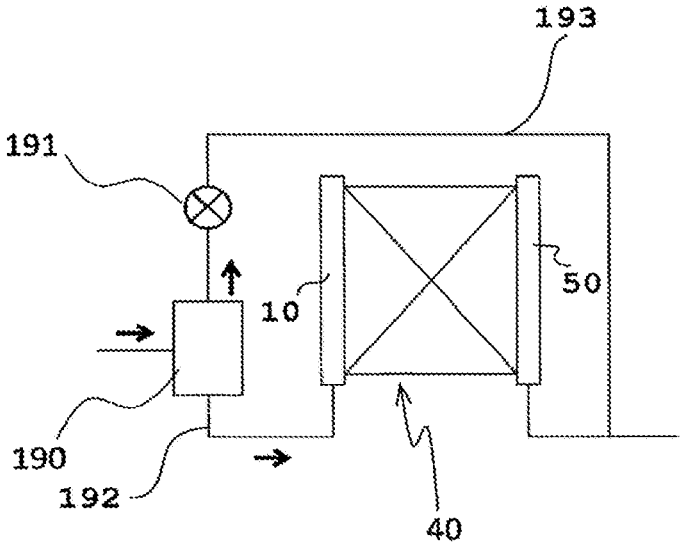
FIG. 37 is a schematic diagram of a portion of a refrigerant cycle according to Embodiment 12 of the present invention.

Embodiment 12 of the present invention will now be described with reference to FIG. 37. FIG. 37 is a schematic diagram of a portion of a refrigerant cycle of a refrigeration cycle apparatus according to Embodiment 12 of the present invention. In FIG. 37, components the same as or equivalent to those in Embodiments 1 to 11 are denoted with the same reference signs, and components the same as those in Embodiments 1 to 11 will not be fully described. A gas-liquid separator 190 is connected to an upstream portion of the heat source side heat exchanger 40. A lower portion of the gas-liquid separator 190 and an upstream portion of the heat source side heat exchanger 40 are connected to each other with a refrigerant cycle 192. An upper portion of the gas-liquid separator 190 and a downstream portion of the heat source side heat exchanger 40 are connected to each other with a refrigerant cycle 193. The refrigerant cycle 192 is a first refrigerant circuit of an embodiment of the present invention. The refrigerant cycle 193 is a second refrigerant circuit of an embodiment of the present invention. In the refrigerant cycle 193, a flow control valve 191 is disposed between the gas-liquid separator 190 and the heat source side heat exchanger 40. The refrigerant cycle 192 and the refrigerant cycle 193 are joined together on the downstream side of the heat source side heat exchanger 40. A liquid refrigerant flows out from a lower portion of the gas-liquid separator 190, and is preferentially distributed to the refrigerant cycle 192.

In an operation state under nearly a 100% load as in the case of a rated heating operation, the flow control valve 191 is controlled to open. This control prevents a liquid refrigerant that excessively flows from flowing to the heat exchanger core 40B disposed on the leeward side of the heat source side heat exchanger 40 through the header refrigerant distributor 10, and allows a liquid refrigerant to flow at a higher rate to the heat exchanger core 40A disposed on the windward side. For example, the heat exchange efficiency can be improved by reducing the quality from 0.2 to 0.05 and by reducing the pressure loss inside the pipe of the heat source side heat exchanger 40. In an operation state under a 25% to 50% load as in the case of a medium heating operation, the flow control valve 191 is controlled to be closed. This control allows the whole two-phase gas-liquid refrigerant that has flowed into the gas-liquid separator 190 to flow to the heat source side heat exchanger 40 to prevent reduction of the heat exchange efficiency.

Embodiment 13

Generally, a zeotropic refrigerant mixture having different boiling points contains, in the two-phase gas-liquid state, a large amount of a low-boiling component in gas and a large amount of a high-boiling component in liquid. Thus, the zeotropic refrigerant mixture used in an evaporator has a smaller temperature difference between a liquid refrigerant and air than that in the case where a pure refrigerant is used in an evaporator. Thus, to improve the performance, a zeotropic refrigerant mixture is more preferably used than a pure refrigerant because this zeotropic refrigerant mixture relatively enhances the effect of a distribution structure that allows a liquid refrigerant to flow at a higher rate to the heat exchanger core 40A disposed on the windward side. Examples of a zeotropic refrigerant mixture having different boiling points include a refrigerant mixture containing two or more types of refrigerant including a hydrofluorocarbon (HFC) refrigerant such as R32 and an olefin-based refrigerant such as R1234yf or R1234ze (E), and a refrigerant mixture containing, for example, CO2, propane, and dimethyl ether (DME). In Embodiment 13, such a zeotropic refrigerant mixture is used.

The present invention is not limited to the above embodiments and may be modified in various manners within the scope of the present invention. Specifically, the components of the above embodiments may be modified as appropriate, or some of the components may be replaced with other components. Instead of the position disclosed in any of the embodiments, components whose arrangement is not limited to particular ones may be disposed at any positions at which they can exert their functions.

For example, an example where the header refrigerant distributor 10 or the header refrigerant distributor 90 is connected to the heat source side heat exchanger 40 has been described. However, the header refrigerant distributor 10 or the header refrigerant distributor 90 may be connected to the use side heat exchanger 180. In the above description, at least one of the heat source side heat exchanger 40 and the use side heat exchanger 180 corresponds to a heat exchanger of an embodiment of the present invention.

Figure 38:
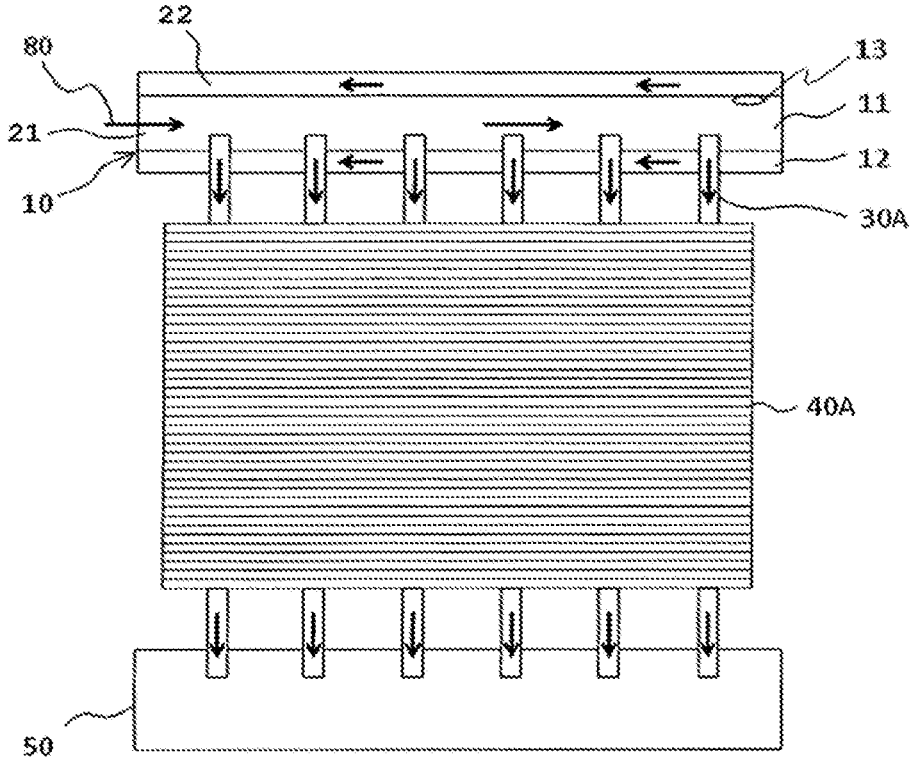
FIG. 38 is a schematic diagram of a structure of a heat source side heat exchanger in which a header refrigerant distributor is disposed to extend horizontally.
Figure 39:
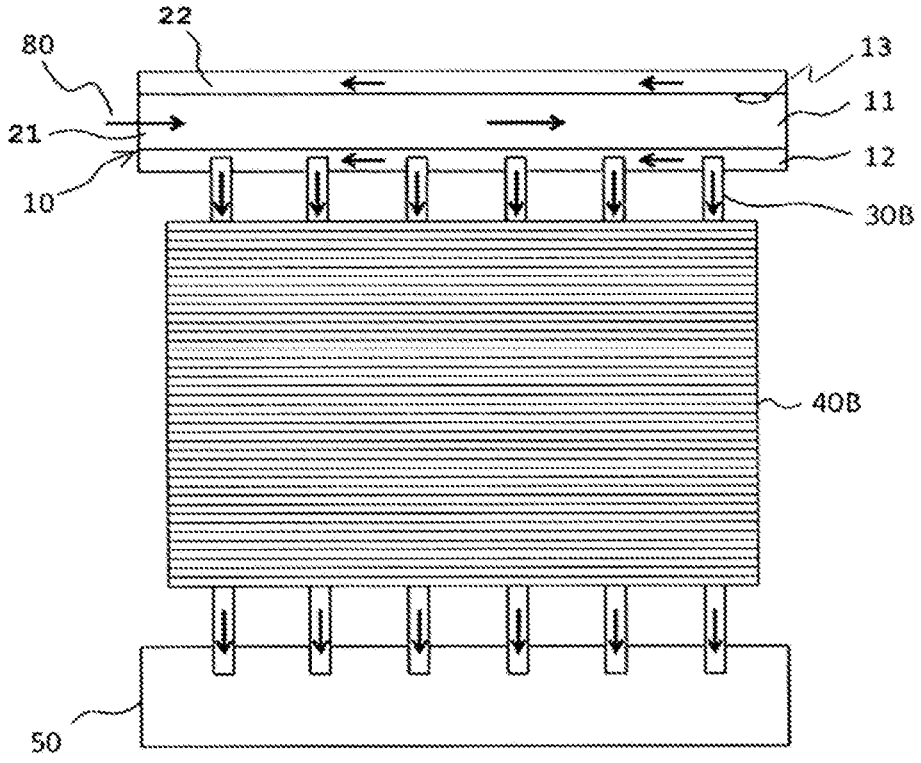
FIG. 39 is a schematic diagram of a structure of a heat source side heat exchanger in which a header refrigerant distributor is disposed to extend horizontally.

In Embodiments 1 to 7, the header refrigerant distributor 10 and the header refrigerant distributor 90 are disposed to have their longitudinal directions extending in the vertical direction. However, the longitudinal direction of each header refrigerant distributor is not necessarily limited to the vertical direction. The header refrigerant distributor may be disposed to have its longitudinal direction extending in the horizontal direction. FIG. 38 and FIG. 39 are schematic diagrams of a structure of a heat source side heat exchanger in which a header refrigerant distributor is disposed to extend horizontally. In FIG. 38 and FIG. 39, components the same as or equivalent to those in Embodiments 1 to 7 are denoted with the same reference signs, and will not be described in detail. A heat exchanger illustrated in FIG. 38 and FIG. 39 has a header refrigerant distributor 10 disposed on an upper portion and a header refrigerant collector 50 disposed on a lower portion. FIG. 38 illustrates a structure of the heat exchanger core 40A in the first row, the header refrigerant distributor 10, and the header refrigerant collector 50 of the heat exchanger. FIG. 39 illustrates a structure of the heat exchanger core 40B in the second row, the header refrigerant distributor 10, and the header refrigerant collector 50 of the heat exchanger. As indicated with arrow 80 in FIG. 38, refrigerant flows into the inner pipe flow path 21 of the header refrigerant distributor 10, and is distributed to the heat transfer tubes 30A connected to the inner pipe 11. The refrigerant then passes through the discharge port 13 and flows to the annular flow path 22. As illustrated in FIG. 39, the refrigerant flows from the annular flow path 22 to the heat transfer tubes 30B. In this manner, also when the header refrigerant distributor 10 is disposed to have its longitudinal direction extending in the horizontal direction, refrigerant can be distributed at a higher rate to the heat exchanger A in the first row, so that the above effects can be obtained.

Figure 40:
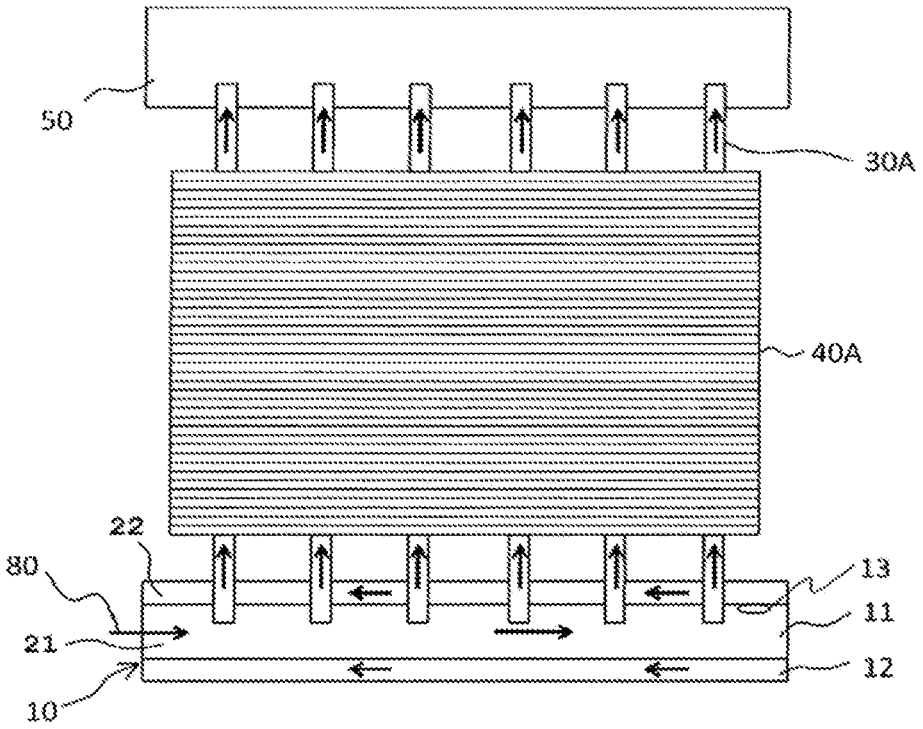
FIG. 40 is a schematic diagram of a structure of a heat source side heat exchanger in which a header refrigerant distributor is disposed to extend horizontally.
Figure 41:
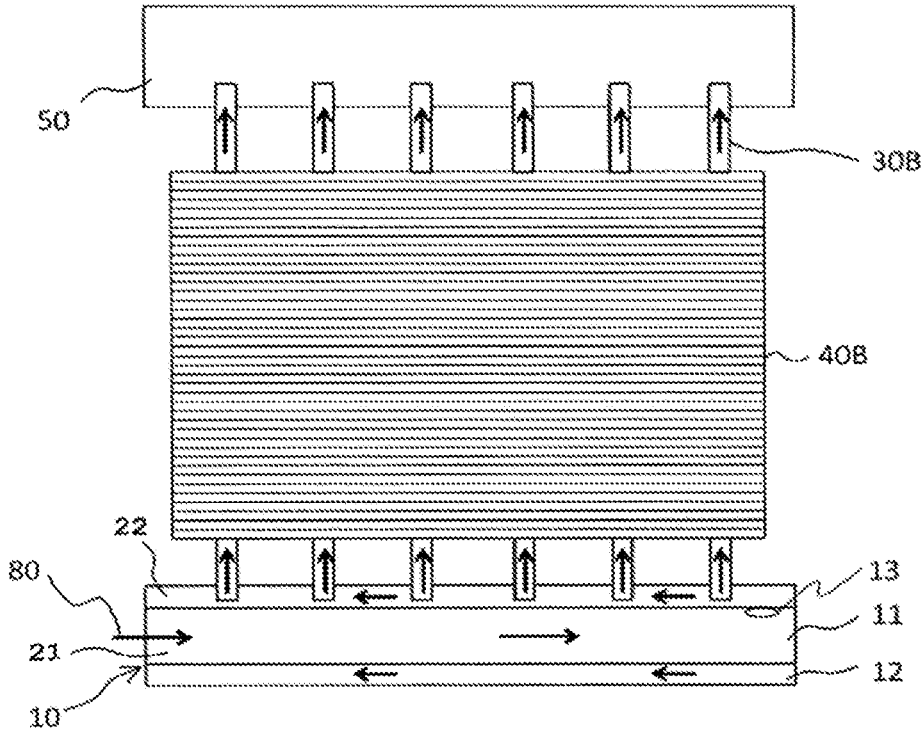
FIG. 41 is a schematic diagram of a structure of a heat source side heat exchanger in which a header refrigerant distributor is disposed to extend horizontally.

FIG. 40 and FIG. 41 are schematic diagrams of a structure of a heat source side heat exchanger in which a header refrigerant distributor is disposed to extend horizontally. In FIG. 40 and FIG. 41, components the same as or equivalent to those in Embodiments 1 to 7 are denoted with the same reference signs, and will not be described in detail. A heat exchanger illustrated in FIG. 40 and FIG. 41 has a header refrigerant distributor 10 disposed on a lower portion and a header refrigerant collector 50 disposed on an upper portion. FIG. 40 illustrates a structure of the heat exchanger core 40A in the first row, the header refrigerant distributor 10, and the header refrigerant collector 50 of the heat exchanger. FIG. 41 illustrates a structure of the heat exchanger core 40B in the second row, the header refrigerant distributor 10, and the header refrigerant collector 50 of the heat exchanger. The flow of refrigerant is indicated with arrow 80. In this manner, also when the header refrigerant distributor 10 is disposed on a lower portion to have its longitudinal direction extending in the horizontal direction, refrigerant can be distributed at a higher rate to the heat exchanger core 40A in the first row, and the above effects can be obtained.

REFERENCE SIGNS LIST

1 refrigeration cycle apparatus 1A heat source side unit 1B use side unit 10 header refrigerant distributor 11 inner pipe 11A inside diameter 11B outside diameter 12 outer pipe 12A inside diameter 13 discharge port 14 inlet port 21 inner pipe flow path 22 annular flow path 23 insertion hole 24 insertion hole 25 insertion hole 26 solder portion 27 solder portion 30 heat transfer tube 30A heat transfer tube 30B heat transfer tube 30C heat transfer tube 31A amount of insertion 32 liquid membrane 40 heat source side heat exchanger 40A heat exchanger core 40B heat exchanger core 40C heat exchanger core 41 fin 50 header refrigerant collector 60 fan 81 lubricating oil 82 check valve 84 oil outlet 90 header refrigerant distributor 90A first chamber 90B second chamber 91 partitioning wall 93 discharge port 94 insertion hole 95 insertion hole 100 header refrigerant distributor 100A first chamber 100B second chamber 101 hollow cylinder portion 102 partitioning wall 110 compressor 120 header refrigerant distributor 120A first chamber 120B second chamber 120C third chamber 121 partitioning wall 122 partitioning wall 123 discharge port 124 discharge port 130 bypass 150 throttle device 160 flow path switching device 170 accumulator 180 use side heat exchanger 190 gas-liquid separator 191 flow control valve 192 refrigerant cycle 193 refrigerant cycle 300A heat transfer tube 300B heat transfer tube 300C heat transfer tube

The invention claimed is:

1. A heat exchanger that allows air and refrigerant to exchange heat therebetween, the heat exchanger comprising:

a plurality of heat exchanger cores including a plurality of heat transfer tubes arranged side by side and a plurality of fins, one of the cores is a windward core that is disposed on a windward side of a flow of the fed air and an other of the cores is a leeward core that is disposed on a leeward side of the flow of the fed air; and a distributor to which the plurality of heat transfer tubes of the plurality of heat exchanger cores are connected to distribute the refrigerant therebetween, wherein the distributor is a pipe-shaped member, and includes a partitioning wall that extends in a longitudinal direction of the distributor in an inside thereof, wherein the inside of the distributor is divided by the partitioning wall into a first chamber and a second chamber that form the refrigerant flow path, wherein an inlet port for the refrigerant is formed in the first chamber at one longitudinal end portion of the distributor, wherein a discharge port that connects the first chamber and the second chamber to each other is formed between the partitioning wall and the distributor at an other longitudinal end portion of the distributor, wherein the plurality of heat transfer tubes of the windward cores are connected to the first chamber, wherein the plurality of heat transfer tubes of leeward cores are connected to the second chamber, and wherein in the first chamber the refrigerant flows from the one longitudinal end to the other longitudinal end and in the second chamber the refrigerant flows from the other longitudinal end to the one longitudinal end.

2. The heat exchanger of claim 1, wherein end portions of the plurality of heat transfer tubes of the heat exchanger core disposed on the leeward side opposite to end portions connected to the distributor, and end portions of the plurality of heat transfer tubes of the heat exchanger core disposed on the windward side opposite to end portions connected to the distributor are connected to a collector that gathers the refrigerant.

3. The heat exchanger of claim 1, wherein the distributor has a double pipe structure that includes a cylindrical outer pipe, and a cylindrical inner pipe disposed inside the outer pipe, wherein an inner pipe flow path that forms the refrigerant flow path is defined by an inner side of the inner pipe, wherein an annular flow path that forms the refrigerant flow path and that has an annular cross section is defined by an outer side of the inner pipe and an inner side of the outer pipe, wherein an inlet port for the refrigerant is disposed at one of both end portions of the inner pipe, and wherein a discharge port that connects the inner pipe flow path and the annular flow path to each other is disposed at an other one of both end portions of the inner pipe.

4. The heat exchanger of claim 3, wherein insertion holes of the outer pipe into which the plurality of heat transfer tubes of the heat exchanger core on the windward side are inserted are offset in a direction perpendicular to an axial direction of the distributor relative to insertion holes of the outer pipe into which the plurality of heat transfer tubes of the heat exchanger core on the leeward side are inserted.

5. The heat exchanger of claim 3, wherein insertion holes of the outer pipe into which the plurality of heat transfer tubes of the heat exchanger core on the windward side are inserted are offset in an axial direction of the distributor relative to insertion holes of the outer pipe into which the plurality of heat transfer tubes of the heat exchanger core on the leeward side are inserted.

6. The heat exchanger of claim 3, wherein the plurality of heat transfer tubes of the heat exchanger core on the windward side are directed to a center axis of the distributor while being inserted into the inner pipe and the outer pipe, and the plurality of heat transfer tubes of the heat exchanger core on the leeward side are directed to the center axis of the distributor while being inserted into the outer pipe.

7. The heat exchanger of claim 3, wherein a center axis of the inner pipe is misaligned with a center axis of the outer pipe, and part of an outer peripheral surface of the inner pipe is located closer to part of an inner peripheral surface of the outer pipe.

8. The heat exchanger of claim 1, wherein the plurality of heat transfer tubes of the heat exchanger core disposed on the windward side of the flow of the air are connected to a side surface of the first chamber, and wherein the plurality of heat transfer tubes of the heat exchanger core disposed on the leeward side of the flow of the air are connected to a side surface of the second chamber.

9. The heat exchanger of claim 3, wherein a longitudinal direction of the distributor extends in a vertical direction.

10. The heat exchanger of claim 3, wherein a longitudinal direction of the distributor extends in a horizontal direction.

11. The heat exchanger of claim 3, wherein a longitudinal direction of the distributor is inclined relative to a vertical direction.

12. The heat exchanger of claim 1, wherein the heat exchanger cores are arranged in three or more rows in a direction of the flow of the air.

13. The heat exchanger of claim 3, further comprising:

a bypass disposed below the distributor in a direction of gravity to connect the plurality of refrigerant flow paths, wherein the bypass includes a check valve that blocks a flow of a fluid from the refrigerant flow path located on the upstream side of the flow of the refrigerant to the refrigerant flow path located on the downstream side of the flow of the refrigerant.

14. The heat exchanger of claim 3, further comprising:

a bypass disposed below the distributor in a direction of gravity to connect the plurality of refrigerant flow paths to each other, wherein the bypass includes a flow control valve that adjusts a flow rate of a fluid flowing from the refrigerant flow path located on the downstream side of the flow of the refrigerant to the refrigerant flow path located on the upstream side of the flow of the refrigerant.

15. The heat exchanger of claim 3, wherein an opening that connects the plurality of refrigerant flow paths to each other is formed at a lower end portion of the distributor in a direction of gravity.

16. The heat exchanger of claim 1, wherein the refrigerant is a zeotropic refrigerant mixture.

17. The heart exchanger of claim 1, wherein the partitioning wall includes only one opening between the first one of the plurality of refrigerant flow paths the second one of the plurality of refrigerant flow paths.

18. The heat exchanger of claim 1, wherein the first one of the refrigerant flow paths is defined by an inner surface of an outer wall of the distributor and a first surface of the partitioning wall, and the second one of the refrigerant flow paths is defined by the inner surface of the outer wall of the distributor and a second surface of the partitioning wall that is opposite the first surface of the partitioning wall.

19. The heat exchanger of claim 1, wherein the distributor has first and second closed end portions, and the partitioning wall is in contact with the first closed end portion of the distributor and is separated from the second closed end portion of the distributor.

20. A refrigeration cycle apparatus, comprising:

a heat exchanger that allows air and refrigerant to exchange heat therebetween, the heat exchanger including a plurality of heat exchanger cores including a plurality of heat transfer tubes arranged side by side and a plurality of fins, one of the cores is a windward core that is disposed on a windward side of a flow of the fed air and an other of the cores is a leeward core that is disposed on a leeward side of the flow of the fed air; and a distributor to which the plurality of heat transfer tubes of the plurality of heat exchanger cores are connected to distribute the refrigerant therebetween, wherein the distributor is a pipe-shaped member, and includes a partitioning wall that extends in a longitudinal direction of the distributor in an inside thereof, wherein the inside of the distributor is divided by the partitioning wall into a first chamber and a second chamber that form the refrigerant flow path, wherein an inlet port for the refrigerant is formed in the first chamber at one longitudinal end portion of the distributor, wherein a discharge port that connects the first chamber and the second chamber to each other is formed between the partitioning wall and the distributor at an other longitudinal end portion of the distributor, wherein the plurality of heat transfer tubes of the windward cores are connected to the first chamber, wherein the plurality of heat transfer tubes of the leeward cores are connected to the second chamber, and wherein in the first chamber the refrigerant flows from the one longitudinal end to the other longitudinal end and in the second chamber the refrigerant flows from the other longitudinal end to the one longitudinal end; and a fan that supplies air to the heat exchanger.

21. A refrigeration cycle apparatus that includes a heat exchanger that allows air and refrigerant to exchange heat therebetween, the heat exchanger including a plurality of heat exchanger cores including a plurality of heat transfer tubes arranged side by side and a plurality of fins, one of the cores is a windward core that is disposed on a windward side of a flow of the fed air and an other of the cores is a leeward core that is disposed on a leeward side of the flow of the fed air; and a distributor to which the plurality of heat transfer tubes of the plurality of heat exchanger cores are connected to distribute the refrigerant therebetween, wherein the distributor is a pipe-shaped member, and includes a partitioning wall that extends in a longitudinal direction of the distributor in an inside thereof, wherein the inside of the distributor is divided by the partitioning wall into a first chamber and a second chamber that form the refrigerant flow path, wherein an inlet port for the refrigerant is formed in the first chamber at one longitudinal end portion of the distributor, wherein a discharge port that connects the first chamber and the second chamber to each other is formed between the partitioning wall and the distributor at an other longitudinal end portion of the distributor, wherein the plurality of heat transfer tubes of the windward cores are connected to the first chamber, wherein the plurality of heat transfer tubes of the leeward cores are connected to the second chamber, and wherein in the first chamber the refrigerant flows from the one longitudinal end to the other longitudinal end and in the second chamber the refrigerant flows from the other longitudinal end to the one longitudinal end, and a gas-liquid separator disposed upstream of the heat exchanger, the apparatus comprising:

a first refrigerant circuit that connects a lower portion of the gas-liquid separator and an upstream side of the heat exchanger to each other; and a second refrigerant circuit that connects an upper portion of the gas-liquid separator and a downstream side of the heat exchanger to each other, wherein the second refrigerant circuit includes a flow control valve that adjusts a flow rate of the refrigerant.

* * * * *